US009920753B2

(12) United States Patent
Douglas et al.

(10) Patent No.: US 9,920,753 B2
(45) Date of Patent: Mar. 20, 2018

(54) CANTED OFF-AXIS DRIVER FOR QUIET PNEUMATIC PUMPING

(71) Applicant: Nextern, Inc., Saint Paul, MN (US)

(72) Inventors: Ryan Douglas, Stillwater, MN (US); Casey Carlson, Independence, MN (US); Dennis Berke, Riverfalls, MN (US)

(73) Assignee: Nextern, Inc., White Bear Lake, MN (US)

( * ) Notice: Subject to any disclaimer, the term of this patent is extended or adjusted under 35 U.S.C. 154(b) by 323 days.

(21) Appl. No.: 14/796,756

(22) Filed: Jul. 10, 2015

(65) Prior Publication Data

US 2016/0047365 A1 Feb. 18, 2016

Related U.S. Application Data

(60) Provisional application No. 62/036,959, filed on Aug. 13, 2014, provisional application No. 62/171,725, filed on Jun. 5, 2015.

(51) Int. Cl.

| | |
|---|---|
| ***F01B 3/00*** | (2006.01) |
| ***F04B 43/04*** | (2006.01) |
| ***F04B 43/02*** | (2006.01) |

(52) U.S. Cl.
CPC ..... *F04B 43/04* (2013.01); *F04B 43/021* (2013.01)

(58) Field of Classification Search
CPC ..... F04B 43/02; F04B 43/021; F04B 43/04
USPC ..... 74/60
See application file for complete search history.

(56) References Cited

U.S. PATENT DOCUMENTS

| | | | | |
|---|---|---|---|---|
| 3,172,368 | A | 3/1965 | Mashinter | |
| 3,261,216 | A | 7/1966 | Woolfenden | |
| 3,912,044 | A | 10/1975 | Schindelhauer | |
| 3,961,869 | A | 6/1976 | Droege, Sr. et al. | |
| 4,153,391 | A | 5/1979 | Hartley | |
| 4,467,941 | A | 8/1984 | Du | |
| 4,797,069 | A | 1/1989 | Hartley et al. | |
| 4,801,249 | A * | 1/1989 | Kakizawa | A61B 5/0235 92/98 D |
| 5,044,891 | A | 9/1991 | Ozawa | |

(Continued)

FOREIGN PATENT DOCUMENTS

| | | |
|---|---|---|
| CA | 2876723 A1 | 12/2013 |
| EP | 2696074 B1 | 1/2015 |

*Primary Examiner* — Michael Leslie
(74) *Attorney, Agent, or Firm* — Craig Thompson; Thompson Patent Law

(57) ABSTRACT

Apparatus and associated methods relate to nutating a piston drive linkage oriented around a longitudinal axis in response to the rotation of a drive shaft about a drive axis of rotation, said longitudinal axis being offset and canted with respect to said drive axis of rotation. In an illustrative example, the piston drive linkage may be formed as an umbrella shape with multiple arm members extending radially from the longitudinal axis. The distal ends of each of the radial arm members may attach to a stationary piston crank. The nutating motion of the piston drive linkage may impart a substantially linear motion profile substantially parallel to the drive axis of rotation. A shaft extending along the longitudinal axis from the piston linkage may advantageously freely insert into and rotate within a receptacle of a spinner body being rotated around the drive axis of rotation.

9 Claims, 36 Drawing Sheets

(56) References Cited

U.S. PATENT DOCUMENTS

| | | | | |
|---|---|---|---|---|
| 5,466,133 | A | 11/1995 | Tuck, Jr. | |
| 5,613,834 | A | 3/1997 | Du | |
| 6,506,012 | B2 | 1/2003 | Tuck, Jr. | |
| 6,716,005 | B2 * | 4/2004 | Yamakawa | F04B 43/026 74/60 |
| 7,451,687 | B2 * | 11/2008 | Lynn | F04B 1/146 74/60 |
| 7,819,636 | B2 * | 10/2010 | Huang | F04B 45/022 417/269 |
| 2014/0161654 | A1 | 6/2014 | Dorfler et al. | |

* cited by examiner

1805

1800

1810

1815

1820

1825

| Spinner Depth (mm) | Moment Arm Length (mm) | | |
|---|---|---|---|
| | 5cyl 17.5 | 8cyl 23.5 | 9cyl 26.5 |
| 8 | 2.19 | 2.94 | 3.31 |
| 8.5 | 2.06 | 2.76 | 3.12 |
| 9 | 1.94 | 2.61 | 2.94 |
| 9.5 | 1.84 | 2.47 | 2.79 |
| 10 | 1.75 | 2.35 | 2.65 |
| 10.5 | 1.67 | 2.24 | 2.52 |
| 11 | 1.59 | 2.14 | 2.41 |
| 11.5 | 1.52 | 2.04 | 2.30 |
| 12 | 1.46 | 1.96 | 2.21 |
| 12.5 | 1.40 | 1.88 | 2.12 |
| 13 | 1.35 | 1.81 | 2.04 |
| 13.5 | 1.30 | 1.74 | 1.96 |
| 14 | 1.25 | 1.68 | 1.89 |
| 14.5 | 1.21 | 1.62 | 1.83 |
| 15 | 1.17 | 1.57 | 1.77 |
| 15.5 | 1.13 | 1.52 | 1.71 |
| 16 | 1.09 | 1.47 | 1.66 |
| 16.5 | 1.06 | 1.42 | 1.61 |
| 17 | 1.03 | 1.38 | 1.56 |
| 17.5 | 1.00 | 1.34 | 1.51 |
| 18 | 0.97 | 1.31 | 1.47 |
| 18.5 | 0.95 | 1.27 | 1.43 |
| 19 | 0.92 | 1.24 | 1.39 |
| 19.5 | 0.90 | 1.21 | 1.36 |
| 20 | 0.88 | 1.18 | 1.33 |

FIG. 18

1900

1905 Moment Arm (mm)

1910 Spinner Depth (mm)

| | 1 | 1.5 | 2 | 2.5 | 3 | 3.5 | 4 | 4.5 | 5 | 5.5 | 6 | 6.5 | 7 |
|---|---|---|---|---|---|---|---|---|---|---|---|---|---|
| 1 | 1.00 | 1.50 | 2.00 | 2.50 | 3.00 | 3.50 | 4.00 | 4.50 | 5.00 | 5.50 | 6.00 | 6.50 | 7.00 |
| 1.5 | 0.67 | 1.00 | 1.33 | 1.67 | 2.00 | 2.33 | 2.67 | 3.00 | 3.33 | 3.67 | 4.00 | 4.33 | 4.67 |
| 2 | 0.50 | 0.75 | 1.00 | 1.25 | 1.50 | 1.75 | 2.00 | 2.25 | 2.50 | 2.75 | 3.00 | 3.25 | 3.50 |
| 2.5 | 0.40 | 0.60 | 0.80 | 1.00 | 1.20 | 1.40 | 1.60 | 1.80 | 2.00 | 2.20 | 2.40 | 2.60 | 2.80 |
| 3 | 0.33 | 0.50 | 0.67 | 0.83 | 1.00 | 1.17 | 1.33 | 1.50 | 1.67 | 1.83 | 2.00 | 2.17 | 2.33 |
| 3.5 | 0.29 | 0.43 | 0.57 | 0.71 | 0.86 | 1.00 | 1.14 | 1.29 | 1.43 | 1.57 | 1.71 | 1.86 | 2.00 |
| 4 | 0.25 | 0.38 | 0.50 | 0.63 | 0.75 | 0.88 | 1.00 | 1.13 | 1.25 | 1.38 | 1.50 | 1.63 | 1.75 |
| 4.5 | 0.22 | 0.33 | 0.44 | 0.56 | 0.67 | 0.78 | 0.89 | 1.00 | 1.11 | 1.22 | 1.33 | 1.44 | 1.56 |
| 5 | 0.20 | 0.30 | 0.40 | 0.50 | 0.60 | 0.70 | 0.80 | 0.90 | 1.00 | 1.10 | 1.20 | 1.30 | 1.40 |
| 5.5 | 0.18 | 0.27 | 0.36 | 0.45 | 0.55 | 0.64 | 0.73 | 0.82 | 0.91 | 1.00 | 1.09 | 1.18 | 1.27 |
| 6 | 0.17 | 0.25 | 0.33 | 0.42 | 0.50 | 0.58 | 0.67 | 0.75 | 0.83 | 0.92 | 1.00 | 1.08 | 1.17 |
| 6.5 | 0.15 | 0.23 | 0.31 | 0.38 | 0.46 | 0.54 | 0.62 | 0.69 | 0.77 | 0.85 | 0.92 | 1.00 | 1.08 |
| 7 | 0.14 | 0.21 | 0.29 | 0.36 | 0.43 | 0.50 | 0.57 | 0.64 | 0.71 | 0.79 | 0.86 | 0.93 | 1.00 |
| 7.5 | 0.13 | 0.20 | 0.27 | 0.33 | 0.40 | 0.47 | 0.53 | 0.60 | 0.67 | 0.73 | 0.80 | 0.87 | 0.93 |
| 8 | 0.13 | 0.19 | 0.25 | 0.31 | 0.38 | 0.44 | 0.50 | 0.56 | 0.63 | 0.69 | 0.75 | 0.81 | 0.88 |
| 8.5 | 0.12 | 0.18 | 0.24 | 0.29 | 0.35 | 0.41 | 0.47 | 0.53 | 0.59 | 0.65 | 0.71 | 0.76 | 0.82 |
| 9 | 0.11 | 0.17 | 0.22 | 0.28 | 0.33 | 0.39 | 0.44 | 0.50 | 0.56 | 0.61 | 0.67 | 0.72 | 0.78 |
| 9.5 | 0.11 | 0.16 | 0.21 | 0.26 | 0.32 | 0.37 | 0.42 | 0.47 | 0.53 | 0.58 | 0.63 | 0.68 | 0.74 |
| 10 | 0.10 | 0.15 | 0.20 | 0.25 | 0.30 | 0.35 | 0.40 | 0.45 | 0.50 | 0.55 | 0.60 | 0.65 | 0.70 |
| 10.5 | 0.10 | 0.14 | 0.19 | 0.24 | 0.29 | 0.33 | 0.38 | 0.43 | 0.48 | 0.52 | 0.57 | 0.62 | 0.67 |
| 11 | 0.09 | 0.14 | 0.18 | 0.23 | 0.27 | 0.32 | 0.36 | 0.41 | 0.45 | 0.50 | 0.55 | 0.59 | 0.64 |
| 11.5 | 0.09 | 0.13 | 0.17 | 0.22 | 0.26 | 0.30 | 0.35 | 0.39 | 0.43 | 0.48 | 0.52 | 0.57 | 0.61 |
| 12 | 0.08 | 0.13 | 0.17 | 0.21 | 0.25 | 0.29 | 0.33 | 0.38 | 0.42 | 0.46 | 0.50 | 0.54 | 0.58 |
| 12.5 | 0.08 | 0.12 | 0.16 | 0.20 | 0.24 | 0.28 | 0.32 | 0.36 | 0.40 | 0.44 | 0.48 | 0.52 | 0.56 |
| 13 | 0.08 | 0.12 | 0.15 | 0.19 | 0.23 | 0.27 | 0.31 | 0.35 | 0.38 | 0.42 | 0.46 | 0.50 | 0.54 |
| 13.5 | 0.07 | 0.11 | 0.15 | 0.19 | 0.22 | 0.26 | 0.30 | 0.33 | 0.37 | 0.41 | 0.44 | 0.48 | 0.52 |
| 14 | 0.07 | 0.11 | 0.14 | 0.18 | 0.21 | 0.25 | 0.29 | 0.32 | 0.36 | 0.39 | 0.43 | 0.46 | 0.50 |
| 14.5 | 0.07 | 0.10 | 0.14 | 0.17 | 0.21 | 0.24 | 0.28 | 0.31 | 0.34 | 0.38 | 0.41 | 0.45 | 0.48 |
| 15 | 0.07 | 0.10 | 0.13 | 0.17 | 0.20 | 0.23 | 0.27 | 0.30 | 0.33 | 0.37 | 0.40 | 0.43 | 0.47 |
| 15.5 | 0.06 | 0.10 | 0.13 | 0.16 | 0.19 | 0.23 | 0.26 | 0.29 | 0.32 | 0.35 | 0.39 | 0.42 | 0.45 |
| 16 | 0.06 | 0.09 | 0.13 | 0.16 | 0.19 | 0.22 | 0.25 | 0.28 | 0.31 | 0.34 | 0.38 | 0.41 | 0.44 |
| 16.5 | 0.06 | 0.09 | 0.12 | 0.15 | 0.18 | 0.21 | 0.24 | 0.27 | 0.30 | 0.33 | 0.36 | 0.39 | 0.42 |
| 17 | 0.06 | 0.09 | 0.12 | 0.15 | 0.18 | 0.21 | 0.24 | 0.26 | 0.29 | 0.32 | 0.35 | 0.38 | 0.41 |
| 17.5 | 0.06 | 0.09 | 0.11 | 0.14 | 0.17 | 0.20 | 0.23 | 0.26 | 0.29 | 0.31 | 0.34 | 0.37 | 0.40 |
| 18 | 0.06 | 0.08 | 0.11 | 0.14 | 0.17 | 0.19 | 0.22 | 0.25 | 0.28 | 0.31 | 0.33 | 0.36 | 0.39 |
| 18.5 | 0.05 | 0.08 | 0.11 | 0.14 | 0.16 | 0.19 | 0.22 | 0.24 | 0.27 | 0.30 | 0.32 | 0.35 | 0.38 |
| 19 | 0.05 | 0.08 | 0.11 | 0.13 | 0.16 | 0.18 | 0.21 | 0.24 | 0.26 | 0.29 | 0.32 | 0.34 | 0.37 |
| 19.5 | 0.05 | 0.08 | 0.10 | 0.13 | 0.15 | 0.18 | 0.21 | 0.23 | 0.26 | 0.28 | 0.31 | 0.33 | 0.36 |
| 20 | 0.05 | 0.08 | 0.10 | 0.13 | 0.15 | 0.18 | 0.20 | 0.23 | 0.25 | 0.28 | 0.30 | 0.33 | 0.35 |

F E D B A C

G

Continued on Fig.19B

FIG. 19A

1900

1905 Moment Arm (mm)

| 7.5 | 8 | 8.5 | 9 | 9.5 | 10 | 10.5 | 11 | 11.5 | 12 | 12.5 | 13 | 13.5 | |
|---|---|---|---|---|---|---|---|---|---|---|---|---|---|
| 7.50 | 8.00 | 8.50 | 9.00 | 9.50 | 10.00 | 10.50 | 11.00 | 11.50 | 12.00 | 12.50 | 13.00 | 13.50 | F |
| 5.00 | 5.33 | 5.67 | 6.00 | 6.33 | 6.67 | 7.00 | 7.33 | 7.67 | 8.00 | 8.33 | 8.67 | 9.00 | |
| 3.75 | 4.00 | 4.25 | 4.50 | 4.75 | 5.00 | 5.25 | 5.50 | 5.75 | 6.00 | 6.25 | 6.50 | 6.75 | |
| 3.00 | 3.20 | 3.40 | 3.60 | 3.80 | 4.00 | 4.20 | 4.40 | 4.60 | 4.80 | 5.00 | 5.20 | 5.40 | |
| 2.50 | 2.67 | 2.83 | 3.00 | 3.17 | 3.33 | 3.50 | 3.67 | 3.83 | 4.00 | 4.17 | 4.33 | 4.50 | |
| 2.14 | 2.29 | 2.43 | 2.57 | 2.71 | 2.86 | 3.00 | 3.14 | 3.29 | 3.43 | 3.57 | 3.71 | 3.86 | |
| 1.88 | 2.00 | 2.13 | 2.25 | 2.38 | 2.50 | 2.63 | 2.75 | 2.88 | 3.00 | 3.13 | 3.25 | 3.38 | |
| 1.67 | 1.78 | 1.89 | 2.00 | 2.11 | 2.22 | 2.33 | 2.44 | 2.56 | 2.67 | 2.78 | 2.89 | 3.00 | |
| 1.50 | 1.60 | 1.70 | 1.80 | 1.90 | 2.00 | 2.10 | 2.20 | 2.30 | 2.40 | 2.50 | 2.60 | 2.70 | |
| 1.36 | 1.45 | 1.55 | 1.64 | 1.73 | 1.82 | 1.91 | 2.00 | 2.09 | 2.18 | 2.27 | 2.36 | 2.45 | |
| 1.25 | 1.33 | 1.42 | 1.50 | 1.58 | 1.67 | 1.75 | 1.83 | 1.92 | 2.00 | 2.08 | 2.17 | 2.25 | E |
| 1.15 | 1.23 | 1.31 | 1.38 | 1.46 | 1.54 | 1.62 | 1.69 | 1.77 | 1.85 | 1.92 | 2.00 | 2.08 | |
| 1.07 | 1.14 | 1.21 | 1.29 | 1.36 | 1.43 | 1.50 | 1.57 | 1.64 | 1.71 | 1.79 | 1.86 | 1.93 | |
| 1.00 | 1.07 | 1.13 | 1.20 | 1.27 | 1.33 | 1.40 | 1.47 | 1.53 | 1.60 | 1.67 | 1.73 | 1.80 | |
| 0.94 | 1.00 | 1.06 | 1.13 | 1.19 | 1.25 | 1.31 | 1.38 | 1.44 | 1.50 | 1.56 | 1.63 | 1.69 | D |
| 0.88 | 0.94 | 1.00 | 1.06 | 1.12 | 1.18 | 1.24 | 1.29 | 1.35 | 1.41 | 1.47 | 1.53 | 1.59 | |
| 0.83 | 0.89 | 0.94 | 1.00 | 1.06 | 1.11 | 1.17 | 1.22 | 1.28 | 1.33 | 1.39 | 1.44 | 1.50 | |
| 0.79 | 0.84 | 0.89 | 0.95 | 1.00 | 1.05 | 1.11 | 1.16 | 1.21 | 1.26 | 1.32 | 1.37 | 1.42 | B |
| 0.75 | 0.80 | 0.85 | 0.90 | 0.95 | 1.00 | 1.05 | 1.10 | 1.15 | 1.20 | 1.25 | 1.30 | 1.35 | |
| 0.71 | 0.76 | 0.81 | 0.86 | 0.90 | 0.95 | 1.00 | 1.05 | 1.10 | 1.14 | 1.19 | 1.24 | 1.29 | |
| 0.68 | 0.73 | 0.77 | 0.82 | 0.86 | 0.91 | 0.95 | 1.00 | 1.05 | 1.09 | 1.14 | 1.18 | 1.23 | A |
| 0.65 | 0.70 | 0.74 | 0.78 | 0.83 | 0.87 | 0.91 | 0.96 | 1.00 | 1.04 | 1.09 | 1.13 | 1.17 | |
| 0.63 | 0.67 | 0.71 | 0.75 | 0.79 | 0.83 | 0.88 | 0.92 | 0.96 | 1.00 | 1.04 | 1.08 | 1.13 | |
| 0.60 | 0.64 | 0.68 | 0.72 | 0.76 | 0.80 | 0.84 | 0.88 | 0.92 | 0.96 | 1.00 | 1.04 | 1.08 | |
| 0.58 | 0.62 | 0.65 | 0.69 | 0.73 | 0.77 | 0.81 | 0.85 | 0.88 | 0.92 | 0.96 | 1.00 | 1.04 | |
| 0.56 | 0.59 | 0.63 | 0.67 | 0.70 | 0.74 | 0.78 | 0.81 | 0.85 | 0.89 | 0.93 | 0.96 | 1.00 | |
| 0.54 | 0.57 | 0.61 | 0.64 | 0.68 | 0.71 | 0.75 | 0.79 | 0.82 | 0.86 | 0.89 | 0.93 | 0.96 | |
| 0.52 | 0.55 | 0.59 | 0.62 | 0.66 | 0.69 | 0.72 | 0.76 | 0.79 | 0.83 | 0.86 | 0.90 | 0.93 | |
| 0.50 | 0.53 | 0.57 | 0.60 | 0.63 | 0.67 | 0.70 | 0.73 | 0.77 | 0.80 | 0.83 | 0.87 | 0.90 | |
| 0.48 | 0.52 | 0.55 | 0.58 | 0.61 | 0.65 | 0.68 | 0.71 | 0.74 | 0.77 | 0.81 | 0.84 | 0.87 | |
| 0.47 | 0.50 | 0.53 | 0.56 | 0.59 | 0.63 | 0.66 | 0.69 | 0.72 | 0.75 | 0.78 | 0.81 | 0.84 | |
| 0.45 | 0.48 | 0.52 | 0.55 | 0.58 | 0.61 | 0.64 | 0.67 | 0.70 | 0.73 | 0.76 | 0.79 | 0.82 | |
| 0.44 | 0.47 | 0.50 | 0.53 | 0.56 | 0.59 | 0.62 | 0.65 | 0.68 | 0.71 | 0.74 | 0.76 | 0.79 | |
| 0.43 | 0.46 | 0.49 | 0.51 | 0.54 | 0.57 | 0.60 | 0.63 | 0.66 | 0.69 | 0.71 | 0.74 | 0.77 | |
| 0.42 | 0.44 | 0.47 | 0.50 | 0.53 | 0.56 | 0.58 | 0.61 | 0.64 | 0.67 | 0.69 | 0.72 | 0.75 | C |
| 0.41 | 0.43 | 0.46 | 0.49 | 0.51 | 0.54 | 0.57 | 0.59 | 0.62 | 0.65 | 0.68 | 0.70 | 0.73 | |
| 0.39 | 0.42 | 0.45 | 0.47 | 0.50 | 0.53 | 0.55 | 0.58 | 0.61 | 0.63 | 0.66 | 0.68 | 0.71 | |
| 0.38 | 0.41 | 0.44 | 0.46 | 0.49 | 0.51 | 0.54 | 0.56 | 0.59 | 0.62 | 0.64 | 0.67 | 0.69 | |
| 0.38 | 0.40 | 0.43 | 0.45 | 0.48 | 0.50 | 0.53 | 0.55 | 0.58 | 0.60 | 0.63 | 0.65 | 0.68 | |

Continued from Fig.19A

Continued on Fig.19C

FIG.19B

1900

1905 Moment Arm (mm)

| 14 | 14.5 | 15 | 15.5 | 16 | 16.5 | 17 | 17.5 | 18 | 18.5 | 19 | 19.5 | 20 | |
|---|---|---|---|---|---|---|---|---|---|---|---|---|---|
| 14.00 | 14.50 | 15.00 | 15.50 | 16.00 | 16.50 | 17.00 | 17.50 | 18.00 | 18.50 | 19.00 | 19.50 | 20.00 | F |
| 9.33 | 9.67 | 10.00 | 10.33 | 10.67 | 11.00 | 11.33 | 11.67 | 12.00 | 12.33 | 12.67 | 13.00 | 13.33 | |
| 7.00 | 7.25 | 7.50 | 7.75 | 8.00 | 8.25 | 8.50 | 8.75 | 9.00 | 9.25 | 9.50 | 9.75 | 10.00 | |
| 5.60 | 5.80 | 6.00 | 6.20 | 6.40 | 6.60 | 6.80 | 7.00 | 7.20 | 7.40 | 7.60 | 7.80 | 8.00 | |
| 4.67 | 4.83 | 5.00 | 5.17 | 5.33 | 5.50 | 5.67 | 5.83 | 6.00 | 6.17 | 6.33 | 6.50 | 6.67 | |
| 4.00 | 4.14 | 4.29 | 4.43 | 4.57 | 4.71 | 4.86 | 5.00 | 5.14 | 5.29 | 5.43 | 5.57 | 5.71 | |
| 3.50 | 3.63 | 3.75 | 3.88 | 4.00 | 4.13 | 4.25 | 4.38 | 4.50 | 4.63 | 4.75 | 4.88 | 5.00 | |
| 3.11 | 3.22 | 3.33 | 3.44 | 3.56 | 3.67 | 3.78 | 3.89 | 4.00 | 4.11 | 4.22 | 4.33 | 4.44 | |
| 2.80 | 2.90 | 3.00 | 3.10 | 3.20 | 3.30 | 3.40 | 3.50 | 3.60 | 3.70 | 3.80 | 3.90 | 4.00 | |
| 2.55 | 2.64 | 2.73 | 2.82 | 2.91 | 3.00 | 3.09 | 3.18 | 3.27 | 3.36 | 3.45 | 3.55 | 3.64 | |
| 2.33 | 2.42 | 2.50 | 2.58 | 2.67 | 2.75 | 2.83 | 2.92 | 3.00 | 3.08 | 3.17 | 3.25 | 3.33 | |
| 2.15 | 2.23 | 2.31 | 2.38 | 2.46 | 2.54 | 2.62 | 2.69 | 2.77 | 2.85 | 2.92 | 3.00 | 3.08 | |
| 2.00 | 2.07 | 2.14 | 2.21 | 2.29 | 2.36 | 2.43 | 2.50 | 2.57 | 2.64 | 2.71 | 2.79 | 2.86 | |
| 1.87 | 1.93 | 2.00 | 2.07 | 2.13 | 2.20 | 2.27 | 2.33 | 2.40 | 2.47 | 2.53 | 2.60 | 2.67 | |
| 1.75 | 1.81 | 1.88 | 1.94 | 2.00 | 2.06 | 2.13 | 2.19 | 2.25 | 2.31 | 2.38 | 2.44 | 2.50 | |
| 1.65 | 1.71 | 1.76 | 1.82 | 1.88 | 1.94 | 2.00 | 2.06 | 2.12 | 2.18 | 2.24 | 2.29 | 2.35 | |
| 1.56 | 1.61 | 1.67 | 1.72 | 1.78 | 1.83 | 1.89 | 1.94 | 2.00 | 2.06 | 2.11 | 2.17 | 2.22 | E |
| 1.47 | 1.53 | 1.58 | 1.63 | 1.68 | 1.74 | 1.79 | 1.84 | 1.89 | 1.95 | 2.00 | 2.05 | 2.11 | |
| 1.40 | 1.45 | 1.50 | 1.55 | 1.60 | 1.65 | 1.70 | 1.75 | 1.80 | 1.85 | 1.90 | 1.95 | 2.00 | |
| 1.33 | 1.38 | 1.43 | 1.48 | 1.52 | 1.57 | 1.62 | 1.67 | 1.71 | 1.76 | 1.81 | 1.86 | 1.90 | |
| 1.27 | 1.32 | 1.36 | 1.41 | 1.45 | 1.50 | 1.55 | 1.59 | 1.64 | 1.68 | 1.73 | 1.77 | 1.82 | |
| 1.22 | 1.26 | 1.30 | 1.35 | 1.39 | 1.43 | 1.48 | 1.52 | 1.57 | 1.61 | 1.65 | 1.70 | 1.74 | |
| 1.17 | 1.21 | 1.25 | 1.29 | 1.33 | 1.38 | 1.42 | 1.46 | 1.50 | 1.54 | 1.58 | 1.63 | 1.67 | D |
| 1.12 | 1.16 | 1.20 | 1.24 | 1.28 | 1.32 | 1.36 | 1.40 | 1.44 | 1.48 | 1.52 | 1.56 | 1.60 | |
| 1.08 | 1.12 | 1.15 | 1.19 | 1.23 | 1.27 | 1.31 | 1.35 | 1.38 | 1.42 | 1.46 | 1.50 | 1.54 | |
| 1.04 | 1.07 | 1.11 | 1.15 | 1.19 | 1.22 | 1.26 | 1.30 | 1.33 | 1.37 | 1.41 | 1.44 | 1.48 | |
| 1.00 | 1.04 | 1.07 | 1.11 | 1.14 | 1.18 | 1.21 | 1.25 | 1.29 | 1.32 | 1.36 | 1.39 | 1.43 | |
| 0.97 | 1.00 | 1.03 | 1.07 | 1.10 | 1.14 | 1.17 | 1.21 | 1.24 | 1.28 | 1.31 | 1.34 | 1.38 | B |
| 0.93 | 0.97 | 1.00 | 1.03 | 1.07 | 1.10 | 1.13 | 1.17 | 1.20 | 1.23 | 1.27 | 1.30 | 1.33 | |
| 0.90 | 0.94 | 0.97 | 1.00 | 1.03 | 1.06 | 1.10 | 1.13 | 1.16 | 1.19 | 1.23 | 1.26 | 1.29 | |
| 0.88 | 0.91 | 0.94 | 0.97 | 1.00 | 1.03 | 1.06 | 1.09 | 1.13 | 1.16 | 1.19 | 1.22 | 1.25 | |
| 0.85 | 0.88 | 0.91 | 0.94 | 0.97 | 1.00 | 1.03 | 1.06 | 1.09 | 1.12 | 1.15 | 1.18 | 1.21 | A |
| 0.82 | 0.85 | 0.88 | 0.91 | 0.94 | 0.97 | 1.00 | 1.03 | 1.06 | 1.09 | 1.12 | 1.15 | 1.18 | |
| 0.80 | 0.83 | 0.86 | 0.89 | 0.91 | 0.94 | 0.97 | 1.00 | 1.03 | 1.06 | 1.09 | 1.11 | 1.14 | |
| 0.78 | 0.81 | 0.83 | 0.86 | 0.89 | 0.92 | 0.94 | 0.97 | 1.00 | 1.03 | 1.06 | 1.08 | 1.11 | |
| 0.76 | 0.78 | 0.81 | 0.84 | 0.86 | 0.89 | 0.92 | 0.95 | 0.97 | 1.00 | 1.03 | 1.05 | 1.08 | |
| 0.74 | 0.76 | 0.79 | 0.82 | 0.84 | 0.87 | 0.89 | 0.92 | 0.95 | 0.97 | 1.00 | 1.03 | 1.05 | |
| 0.72 | 0.74 | 0.77 | 0.79 | 0.82 | 0.85 | 0.87 | 0.90 | 0.92 | 0.95 | 0.97 | 1.00 | 1.03 | |
| 0.70 | 0.73 | 0.75 | 0.78 | 0.80 | 0.83 | 0.85 | 0.88 | 0.90 | 0.93 | 0.95 | 0.98 | 1.00 | |

Continued from Fig.19B

C

FIG.19C

2400

| 2405 | 2410 | | 2415 | | | | 2420 | | | 2425 | 2440 | 2445 |
|---|---|---|---|---|---|---|---|---|---|---|---|---|
| Pump ID | EPDM | HNBR | POM | PPS | PEI | Metal Spinner | As Is (Std. Lube) | No Lube | Petroleum Lube | Hard Shaft | Double Ball Bearing | Configuration |
| C | EP | HN | PO | PP | PE | BR | SL | NO | PL | HS | 2B | |
| | x | | x | | | | x | | | | | EP-PO-SL |
| E | EP | HN | PO | PP | PE | BR | SL | NO | PL | HS | 2B | |
| a | x | | x | | | | | x | | | | EP-PO-NO |
| b | x | | | | | x | | | x | | | EP-BR-PL |
| c | x | | | | | x | | | x | x | | RB-BR-PL-HS |
| F | EP | HN | PO | PP | PE | BR | SL | NO | PL | HS | 2B | |
| a | x | | | x | | | x | | | | | EP-PP-SL |
| b | x | | | x | | | | | x | x | | EP-PP-PL-HS |
| c | x | | | x | | | | | x | x | x | EP-PP-PL-HS-2B |
| d | x | | | | | x | | | x | x | x | EP-BR-PL-HS-2B |
| e | x | | | | x | | | | x | | | EP-PE-PL |
| G | EP | HN | PO | PP | PE | BR | SL | NO | PL | HS | 2B | |
| a | | x | x | | | | x | | | | | HN-PO-SL |
| b | | x | | | | x | | | x | | | HN-BR-PL |
| c | | x | x | | | | | | x | x | | HN-PO-PL-HS |
| d | | x | x | | | | | | x | x | x | HN-PO-PL-HS-2B |
| e | | x | | | | x | | | x | x | x | HN-BR-PL-HS-2B |
| H | EP | HN | PO | PP | PE | BR | SL | NO | PL | HS | 2B | |
| a | | x | | x | | | x | | | | | HN-PP-SL |
| c | | x | | x | | | | | x | x | | HN-PP-PL-HS |
| d | | x | | x | | | | | x | x | x | HN-PP-PL-HS-2B |

FIG.24

CANTED OFF-AXIS DRIVER FOR QUIET PNEUMATIC PUMPING

CROSS-REFERENCES TO RELATED APPLICATIONS

This application claims the benefit of U.S. Provisional Patent Applications Ser. No. 62/036,959, filed by Douglas, et al., on Aug. 13, 2014 and entitled "Canted Off-Axis Driver For Quiet Pneumatic Pumping," and Ser. No. 62/171,725, filed by Douglas, et al., on Jun. 5, 2015 and entitled "Durable Canted Off-Axis Driver For Quiet Pneumatic Pumping."

The entire disclosures of each of the foregoing documents are incorporated herein by reference.

TECHNICAL FIELD

Various embodiments relate generally to pneumatic pumps with low-acoustic output.

BACKGROUND

Pneumatic pumps are compressors of air. Pneumatics are a branch of fluid power, which includes both pneumatics and hydraulics. Pneumatics may be used in many industries, factories, and applications. Pneumatic instruments are powered by compressed air. For example, many dental tools are powered by compressed air. Auto mechanics may use air tools when repairing or replacing parts on vehicles. Pneumatic pumps may inflate inflatable devices, such as tires or air mattresses.

SUMMARY

Apparatus and associated methods relate to nutating a piston drive linkage oriented around a longitudinal axis in response to the rotation of a drive shaft about a drive axis of rotation, said longitudinal axis being offset and canted with respect to said drive axis of rotation. In an illustrative example, the piston drive linkage may be formed as an umbrella shape with multiple arm members extending radially from the longitudinal axis. The distal ends of each of the radial arm members may attach to a stationary piston crank. In some examples, the piston crank may be flexible. The nutating motion of the piston drive linkage may impart a substantially linear motion profile to each piston crank. The motion profile may be, in some examples, substantially parallel to the drive axis of rotation. A shaft extending along the longitudinal axis from the piston linkage may advantageously freely insert into and rotate within a receptacle of a spinner body being rotated around the drive axis of rotation.

Various embodiments may relate to a pneumatic pump having a canted off-axis drive to reciprocate a number of pliable pistons operably connected to an equal number of radially arranged piston cranks, with an optimized Moment-Insertion Ratio (MIR) between (i) a radial moment arm of any one of the piston cranks and (ii) a shaft insertion depth into a canted off-axis driver bearing. In an illustrative example, the optimal MIR may yield substantially reduced wear and improved service life when the forces that the canted off-axis driver bearing imparts radially onto the shaft are substantially equal and opposite in magnitude. The radial moment arm may extend from an axis of the shaft to, for example, any of at least two linearly actuatable pliable-pistons. In some embodiments, each of the radially arranged piston cranks may be coupled to the shaft at a common point along the shaft.

In some embodiments, the pliable-piston driver may provide active drive in both an up-stroke and a down-stroke direction to each of a plurality of pliable pistons. Each of the plurality of pliable pistons may be diaphragm pistons, for example. In some embodiments, the pliable-piston driver may have a drive axle coupled to a drive motor in an off-axis canted fashion. In some embodiments, a drive axle of the canted off-axis pliable-piston driver may traverse a conic surface while maintaining a static rotational orientation of the drive axle. A vertex of the conic surface may be collinear with a central axis of the drive motor, for example. In some embodiments, the pneumatic pump may advantageously provide continuous flow while simultaneously minimizing pump noise.

Various embodiments may achieve one or more advantages. For example, some embodiments may provide long-life, maintenance free and substantially continuous flow of air to a device. Such continuous air flow may advantageously improve comfort of patients wearing pneumatic compression boots, for example. Continuous flow may improve linear ramping of pressures in certain applications. Reduced pulsating of instruments may result from the use of phased piston pumping of air. In some embodiments, the flow rate may be increased by the use of two or more pistons. The cost of driving two or more pistons may be minimized by driving all pistons with a single unitary piston driving element.

Some embodiments may, for example, exhibit substantially improved durability and service life. For instance, certain failure modes associated with wear in the rotating canted off-axis spinner and/or on the shaft of the piston driver may be substantially reduced. In various examples, some embodiments may exhibit substantially reduced failures due to relative motion between the non-rotating shaft and the rotating spinner. In some implementations, component costs may be reduced, less costly materials may be selected to achieve a predetermined service life, and/or reduced maintenance may be achieved.

The details of various embodiments are set forth in the accompanying drawings and the description below. Other features and advantages will be apparent from the description and drawings, and from the claims.

BRIEF DESCRIPTION OF THE DRAWINGS

FIGS. 17-20 depict optimization criteria for design of various embodiments of a pneumatic pump.

FIG. 24 is a chart depicting exemplary combinations of design elements for a pneumatic pump.

Like reference symbols in the various drawings indicate like elements.

DETAILED DESCRIPTION OF ILLUSTRATIVE EMBODIMENTS

To aid understanding, this document is organized as follows. First, some advantages of a phased soft-piston pneumatic pump are briefly introduced using an exemplary scenario of use with reference to FIG. 1. Second, with reference to FIGS. 2-3, the discussion turns to exemplary embodiments that illustrate some exemplary components of an off-axis canted soft-piston-drive pump. Then, exemplary embodiments of an off-axis canted soft-piston driver will be described, with reference to FIGS. 4A-5C. Then, with reference to FIGS. 6A-6B, an exemplary multi-diaphragm assembly is described. Then, with reference to FIGS. 7A-8, other pump components will be described. The up-stroke and down-stroke phases of a reciprocating cycle of a membrane-piston will then be described, with reference to FIGS. 9A-9B. Intake and exhaust pressure profiles will be detailed, with reference to FIG. 10. Finally, with reference to FIGS. 11A-11D, experimentally measured noise performance will be disclosed.

Figure 1:
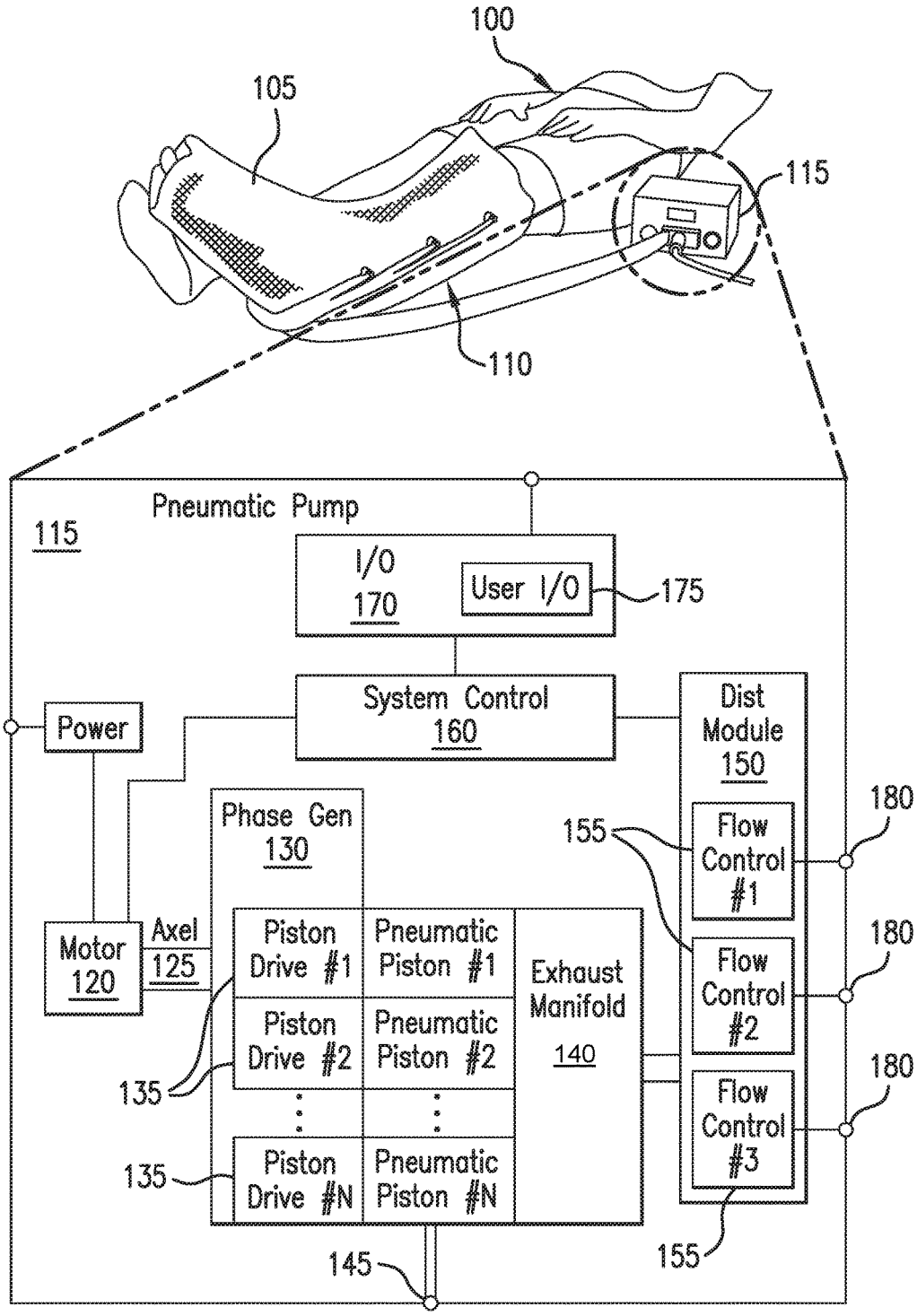
FIG. 1 depicts an exemplary flow pump providing pneumatic pressure to immobilize an injured patient's leg.

FIG. 1 depicts an exemplary flow pump providing pneumatic pressure to immobilize an injured patient's leg. In FIG. 1, a patient 100 is wearing an exemplary compression boot 105. The compression boot may have an inflatable bladder on an interior region to provide compression to a leg 110 of the patient 100. The inflatable bladder may be inflated by a pneumatic pump 115. The pneumatic pump 115 may include a motor 120 that rotates an axle 125. The axle 125 may transmit this rotational energy to a phase generator 130. The phase generator 130 is mechanically coupled to the axle 125 of the motor 120. The phase generator 130 has several, N, piston drivers 135, each coupled to a corresponding deformable piston. Each of the N piston drivers 135 may be configured to drive its corresponding deformable piston in a reciprocating fashion. In some examples, each of the piston driver's 135 reciprocating motion may be out of phase with some or all of the other piston driver's 135 reciprocating motion. A single rotation of the axle 125 may cause each of the N deformable pistons to be reciprocated throughout a complete reciprocation cycle. In an exemplary embodiment, the phases of the N reciprocating cycles of the N deformable pistons may be evenly distributed throughout a single rotation of the axle 125, so that each phase is advanced or delayed by 1/N of a rotation relative to the phases of its nearest neighbors. The resulting air pressure may be produced, for example, at a common exhaust manifold 140 by the N deformable pistons. Such an embodiment may advantageously have small amplitude modulation and the pneumatic pump 120 may quietly produce airflow therethrough.

Each of the N deformable pistons may receive air from an input port 145 and deliver the air to a distribution module 150 via the exhaust manifold 140. In an exemplary embodiment, the distribution module 150 may have one or more flow controllers 155. Each flow controller may receive one or more control signals from a system controller 160. Each of the flow controllers 155 may have an exit port 180. Each of the exit ports 180 may be configured to provide connection to an output pneumatic line and/or device.

While controlling and/or monitoring the operation of the motor 120 and/or distribution module 150, the system controller 160 may further be operatively coupled to an input/output module 170. The input/output module 170 includes a user input/output interface 175. The input/output module 170 may communicate, for example, system status information or global commands with a communications network. For example, the input/output module 170 may report system status information to a logging center. In some embodiments the system controller 160 may receive local operating command signals via the user input/output interface 175. The input/output module 170 may communicate by transmitting and/or receiving digital and/or analog signals using wired and/or wireless communications protocols and/or networks. For example, the system controller 160 may receive operating command signals from a mobile device, and/or transmit status information to the mobile device.

Figure 2:
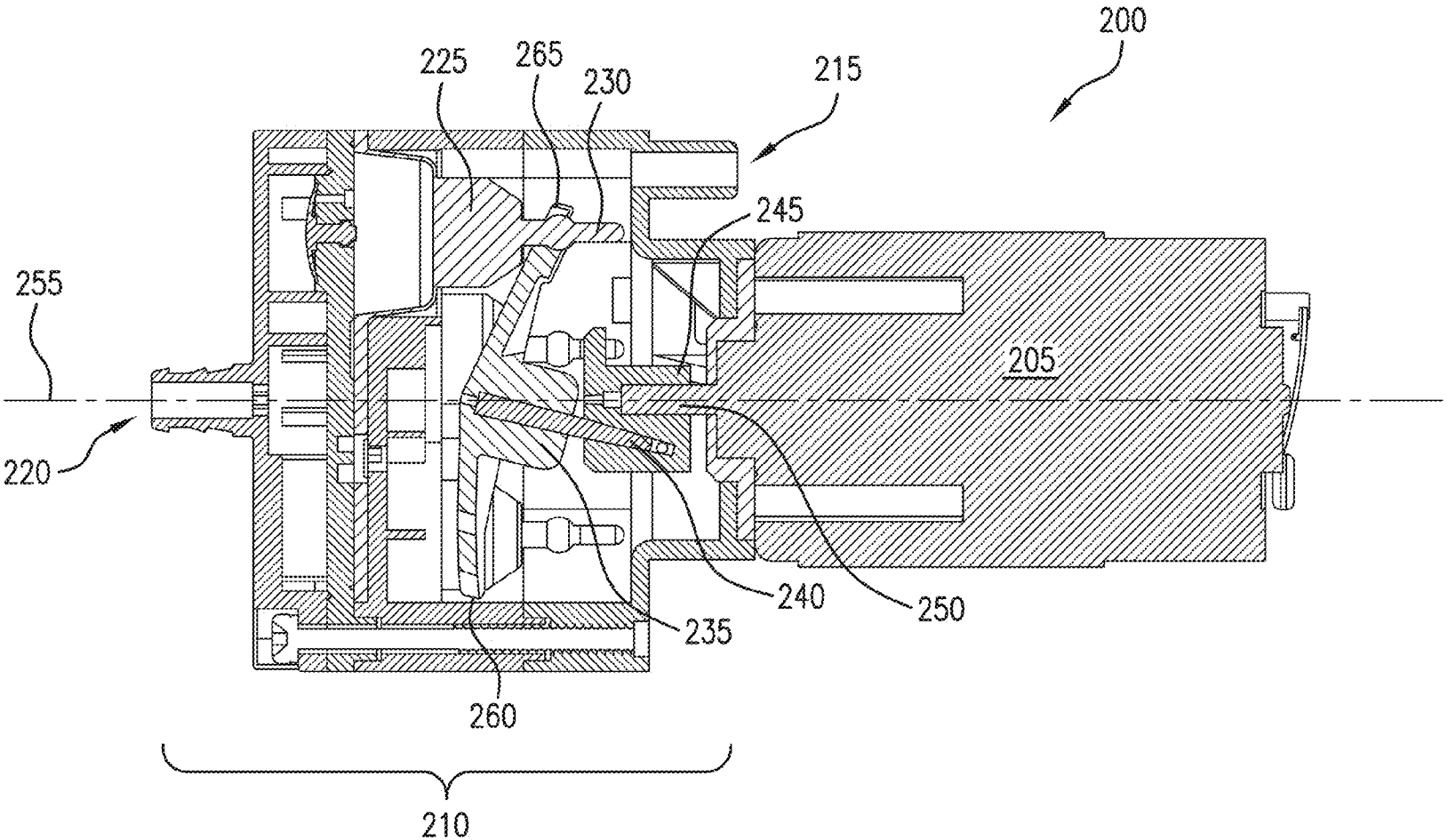
FIG. 2 depicts a cross-sectional view of an exemplary canted off-axis umbrella driven pneumatic pump.

FIG. 2 depicts a cross-sectional view of an exemplary canted off-axis umbrella driven pneumatic pump. In FIG. 2, an exemplary pneumatic pump 200 has a drive motor 205 coupled to a pumping engine 210. The pumping engine 210 may draw air from an intake port 215 and may pump it to an exhaust port 220. The air may be pumped via a plurality of diaphragm pistons 225. Each of the diaphragm pistons 225 is elastically connected to a corresponding piston crank 230. The piston cranks 230 may be securely coupled to an umbrella piston driver 235. The piston cranks may be coupled at regular intervals along a circular path about a central axle 240 of the umbrella piston driver 235. The umbrella piston driver 235 may be coupled to a drive cam 245. The drive cam 245 may couple the central drive axle 240 of the umbrella piston driver 235 to a central drive axle 250 of the drive motor 205. The central axle 240 of the umbrella piston driver 235 may be off-axis and canted with respect to the central axle 250 of the drive motor 205.

In the depicted embodiment, as the drive axle 250 of the drive motor 205 rotates, the drive cam 245 may rotate. As the drive cam 245 rotates, the central axle 240 of the umbrella piston driver 235 may be driven about a central axis 255 of the drive motor 205. The central axle 240 of the umbrella piston driver 235 may define a surface of a cone (not depicted). The canted off-axis central axle 240 orients the umbrella piston driver 235 so that a diaphragm piston connected to a first side 260 may be at an upstroke position and a diaphragm piston 225 connected to a second side 265 may be at a down stroke position.

Figure 3:
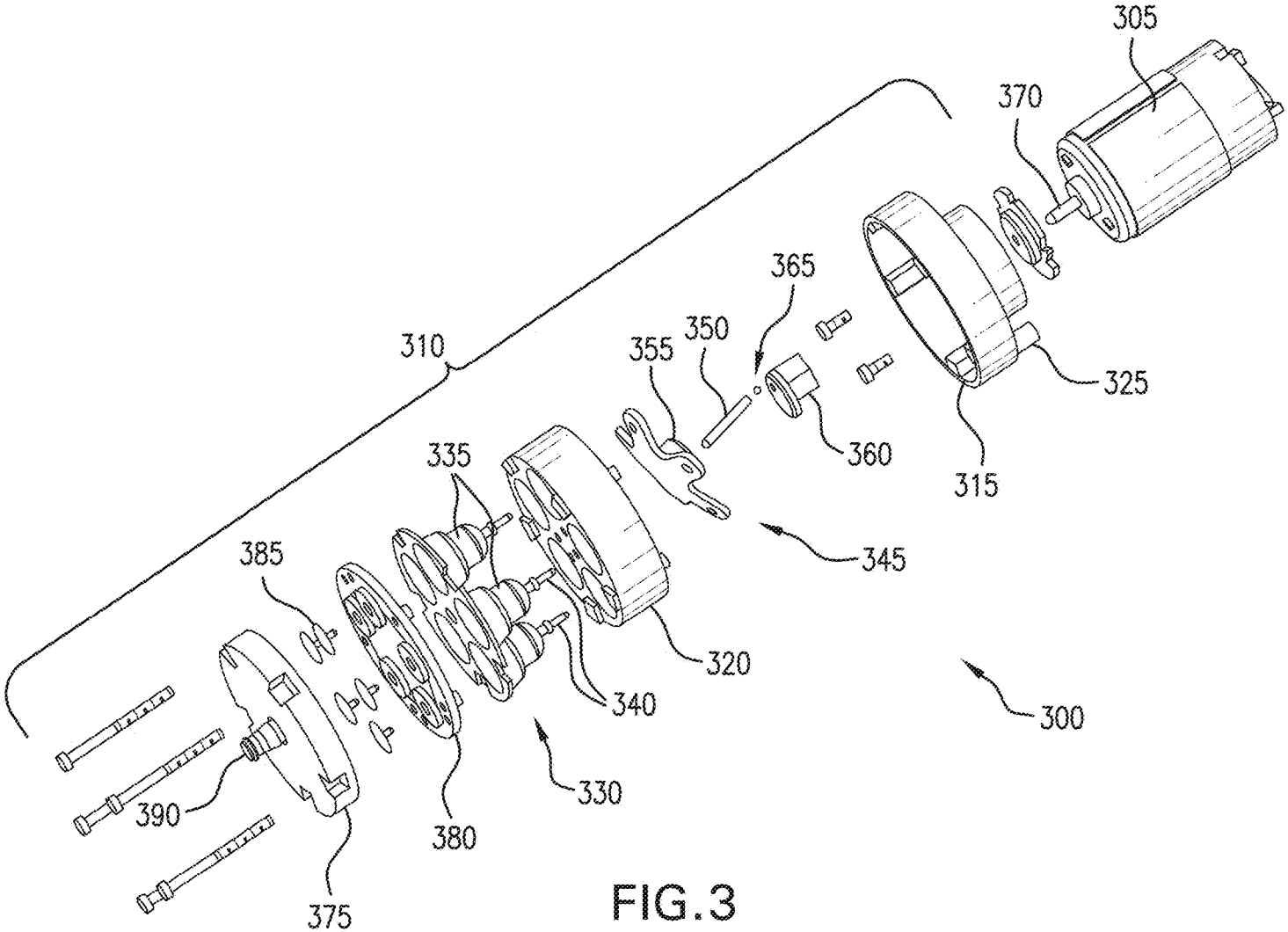
FIG. 3 depicts an exploded view of an exemplary phased-piston pneumatic pump.

FIG. 3 depicts an exploded view of an exemplary phased-piston pneumatic pump. In FIG. 3, a pneumatic pump 300 included a drive motor 305 that is coupleable to a pump engine 310. The pump engine 310 includes a rear housing 315 and a piston block 320. An input manifold may be defined by an internal cavity created by the rear housing 315 and the piston block 320. An input port 325 in the rear housing 315 provides fluid communication between an exterior atmosphere and the input manifold. A unitary piston body 330 may define a plurality of pneumatic pistons 335. The unitary piston body 330 may further define a plurality of input valves. The unitary piston body 330 may provide a sealing surface to the piston block 320. Each pneumatic piston 335 may have an integral crank 340 for driving the pneumatic piston 335. The cranks 340 may project through holes in the piston block 320 so as to be accessible from within the intake manifold.

The cranks 340 may securely couple to an umbrella piston driver 345. The piston cranks 340 may be elastic so as to allow angular deformation of the piston cranks 340. An umbrella drive axle 350 may couple to a central hub 355 of the umbrella piston driver 345. The umbrella drive axle 350 may couple to a motor coupling cam 360. The umbrella drive axle 350 may be coupled to the motor coupling cam 360 in a receiving aperture. The receiving aperture may receive first a ball bearing 365 and then the umbrella drive axle 350. The motor drive cam 360 may be configured to couple to a motor axle 370. When the motor drive cam 360 is coupled to both the motor axle 370 and the umbrella drive axle 350, the umbrella drive axle 350 may be canted with respect to a longitudinal axis of the motor drive axle. In some embodiments, the umbrella drive axle 350 may freely rotate within the receiving aperture of the motor drive cam 360. In some embodiments the umbrella drive axle 350 may freely rotate within an aperture in the central hub 355 of the umbrella piston driver. In an exemplary embodiment, the umbrella drive axle 350 may freely rotate within both the aperture in the central hub 355 and within the receiving aperture of the motor drive cam 370.

An exhaust cavity may be defined by an internal cavity created by a front housing 375 and a valve plate 380. Exhaust valves 385 may be configured to provide unidirectional fluid transport from the pneumatic pistons 335 and the exhaust cavity. Exhaust holes in the valve plate 380 may be aligned to the pneumatic pistons 335. The exhaust valves may permit fluid flow through the aligned holes into the exhaust cavity. The fluid in the exhaust cavity may exit the cavity through an exit port 390.

Figure 4B:
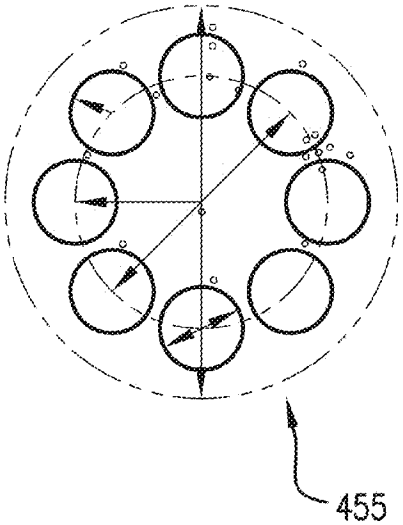
FIGS. 4A-4C depict side elevation and plan views of an exemplary umbrella piston driver.
Figure 4A:
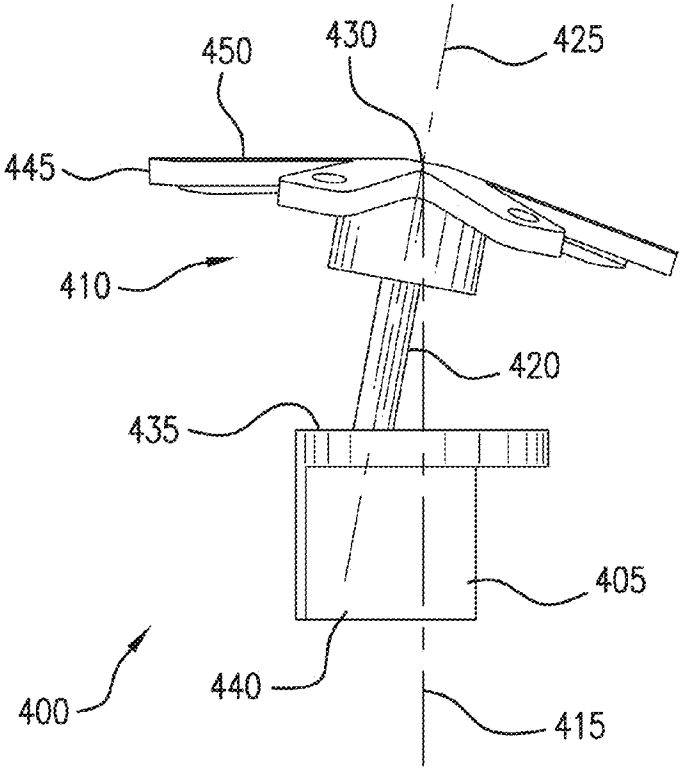
Figure 4C:
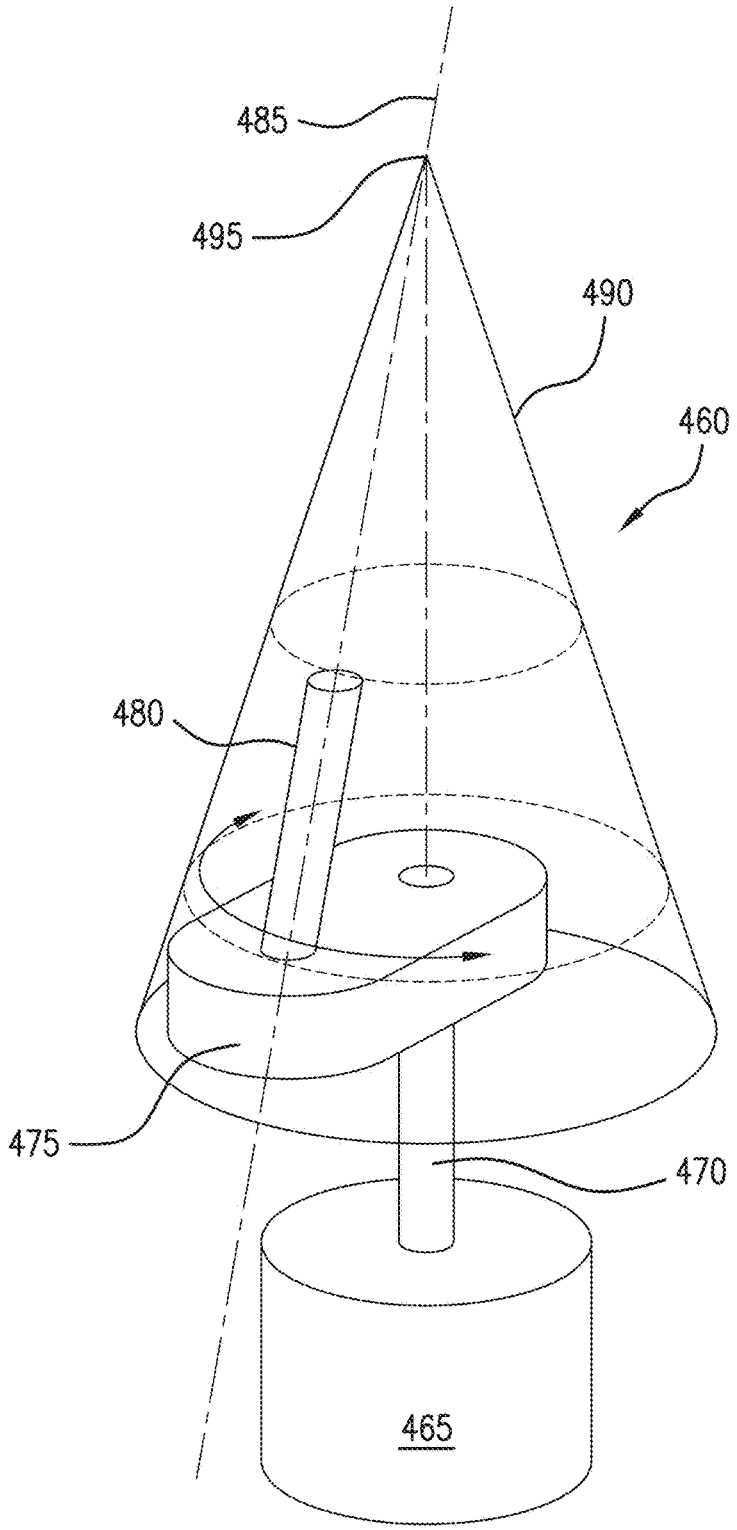

FIGS. 4A-4C depict side elevation and plan views of an exemplary umbrella piston driver. In FIG. 4A, a side perspective view of an off-axis canted dynamic-piston drive module 400 is shown. The off-axis canted dynamic-piston drive module 400 includes a motor drive cam 405 and an umbrella piston driver 410. The motor drive cam 405 may be configured to couple to a motor axle (not depicted) that is axially centered upon a central axis 415. The umbrella piston driver 410 includes a piston driver axle 420. The piston driver axle 420 may be axially centered upon a canted axis 425. A base 430 of the piston driver axle 420 may be coupled to the motor drive cam 405. The central axis 415 and the canted axis 425 may not be collinear. In some embodiments, the central axis 415 and the canted axis 425 may be coplanar. In some embodiments, the central axis 415 and the canted axis 425 may cross at a vertex 430.

In various embodiments, the motor drive cam 405 may have an umbrella end 435 and a motor end 440 opposite the umbrella end 435. The motor drive cam 405 may be configured to couple to a motor axle on the motor end 440 of the motor drive cam 405. The motor drive cam 405 may be configured to couple to the piston drive axle 420 on the umbrella end 435 of the motor drive cam 405. The piston drive axle 420, when coupled to the motor drive cam 405, may project from the motor drive cam 405 from a radial distance, r, from the central axis 415. The piston drive axle 420 may be canted at an angle, α, with respect to the central axis 415. The vertex 430 may be at a vertical distance, h, from the umbrella end 435 of the motor drive cam 405. The angle, α, may relate the radial distance, r, and the vertical distance h as:

$$\tan(\alpha) = \frac{r}{h}$$

The umbrella piston driver 410 may have a plurality of piston arms 445 radially extending from the canted axis 425. Each piston arm 445 may be configured to securely attach to a piston crank. In some embodiments, a piston interface member may extend radially from the canted axis 425 to provide piston interfaces for pneumatic pistons. In the depicted embodiment, a top surface 450 of the piston arms 445 may not be in a plane perpendicular to the canted axis 425, but instead may be deflected below a plane perpendicular to the canted axis 425, toward the motor drive cam 405. In some embodiments, an angle of deflection, β, may be substantially equal to the angle, α. In such an embodiment, the top surface 450 of the piston arm 445 may transition from being coplanar to a plane perpendicular to the central axis 415 and being at an angle of 2α with a plane perpendicular to the central axis 415, as the motor drive cam 405 rotates.

FIG. 4B depicts a top plan view of a piston block 455. In the depicted embodiment, the piston block 455 is configured to receive eight pneumatic pistons. In some embodiments, the piston block 455 may be configured to receive more or fewer pneumatic pistons. For example, in some embodiments, the piston drive block may be configured to receive between 5 and 9 pneumatic pistons. In an exemplary embodiment, the piston drive block may be configured to receive seven pneumatic pistons, for example. In some embodiments, the pistons may be received in a circumferential pattern about a central axis 405. In some embodiments the pistons may have a radial periodic regularity. In an exemplary embodiment, pneumatic pistons may be annularly received at two different radii. For example a piston block may be configured to receive nine pistons on an outer annulus and five pistons on an inner annulus. In an exemplary embodiment, a piston block may be configured to receive 8 large diameter pistons on an outer annulus and eight small diameter pistons on an inner annulus.

FIG. 4C depicts a schematic of an exemplary membrane-piston drive system 460. The membrane-piston drive system 460 includes a motor 465. The motor 465 has a motor shaft 470 that is coupled to a drive coupling cam 475. The drive coupling cam 475 may be coupled to an umbrella drive shaft 480. The umbrella drive shaft 480 may not be axially aligned with the motor drive shaft 470. The umbrella drive shaft 480 may move in response to rotation of the motor drive shaft 470. The umbrella drive shaft 480 may have a longitudinal axis 485 that traces out a cone 490 in response to rotation of the piston drive shaft 480. A vertex 495 of the cone 490 may represent a point at which substantially no movement of a device connected to the umbrella drive shaft 480. For example, if an umbrella-like piston connecting module is coupled to the umbrella drive shaft 480, a tip of the umbrella, if located at the vertex 495 may not move in response to rotation of the motor shaft 470. The umbrella-like piston connecting module may wobble (e.g. like a spinning top), but the tip may remain static, even as the umbrella makes a wobbling motion.

Figure 5A:
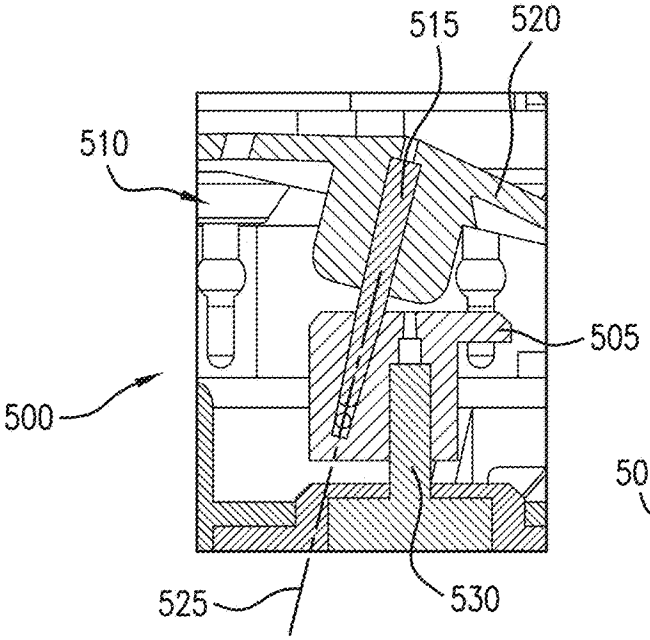
FIGS. 5A-5C depict an exemplary off-axis drive cam.
Figure 5B:
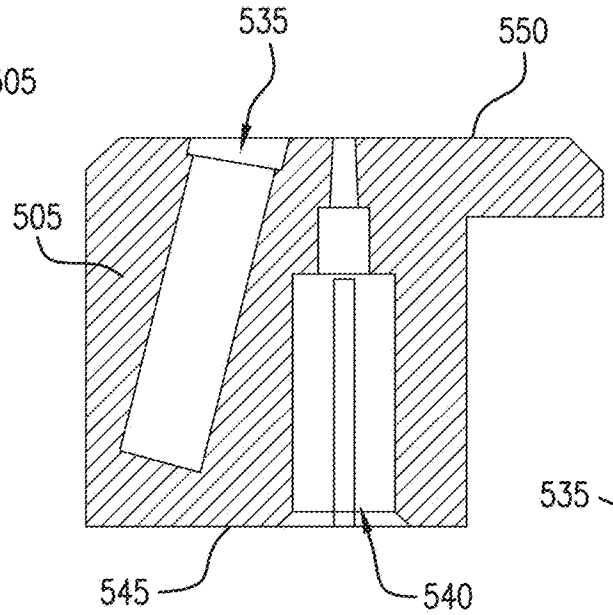
Figure 5C:
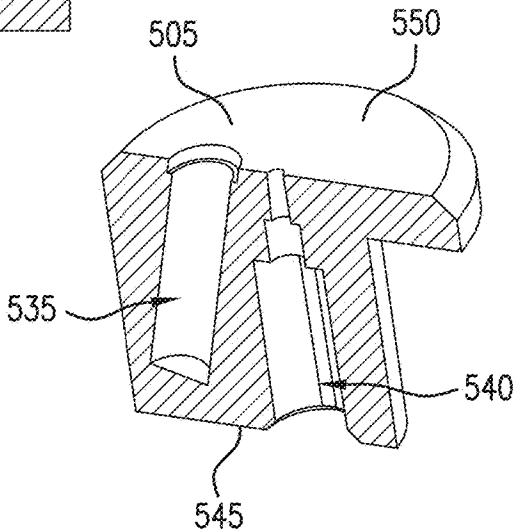

FIGS. 5A-5C depict an exemplary off-axis drive cam. In FIG. 5A, a cross section of an exemplary off-axis canted soft-piston drive module 500 includes a motor drive cam 505 and a soft-piston interface module 510. The soft-piston interface module 510 may include an interface axle 515 and a soft-piston interface member 520. The soft-piston interface member 520 may have radially symmetric piston coupling modules distributed at a fixed radius from an axis 525 of the interface axle 515. The motor drive cam 505 may be configured to couple to a motor axle 530.

In FIGS. 5B-5C, an exemplary motor drive cam 505 is depicted in cross section. The motor drive may have an umbrella-axle interface 535 and a motor drive axle interface 540. The motor drive axle interface 540 may be configured to couple to a motor drive axle from a motor side 545 of the motor drive cam 505. The umbrella-axle interface 535 may be configured to couple to a piston drive axle of the piston drive module 500. The motor drive interface 540 may securely couple the motor drive cam 505 to a motor drive axle. When securely coupled, the motor drive cam 505 may rotate as the motor drive axle rotates. In some embodiments the umbrella-axle interface 535 may be configured to permit piston drive axle rotation about an axis of the piston drive axle. For example, in some embodiments a bushing may facilitate axle rotation. In some embodiments a bearing may facilitate axle rotation. In some embodiments, lubricants may be used to facilitate piston drive axle rotation.

Figure 6A:
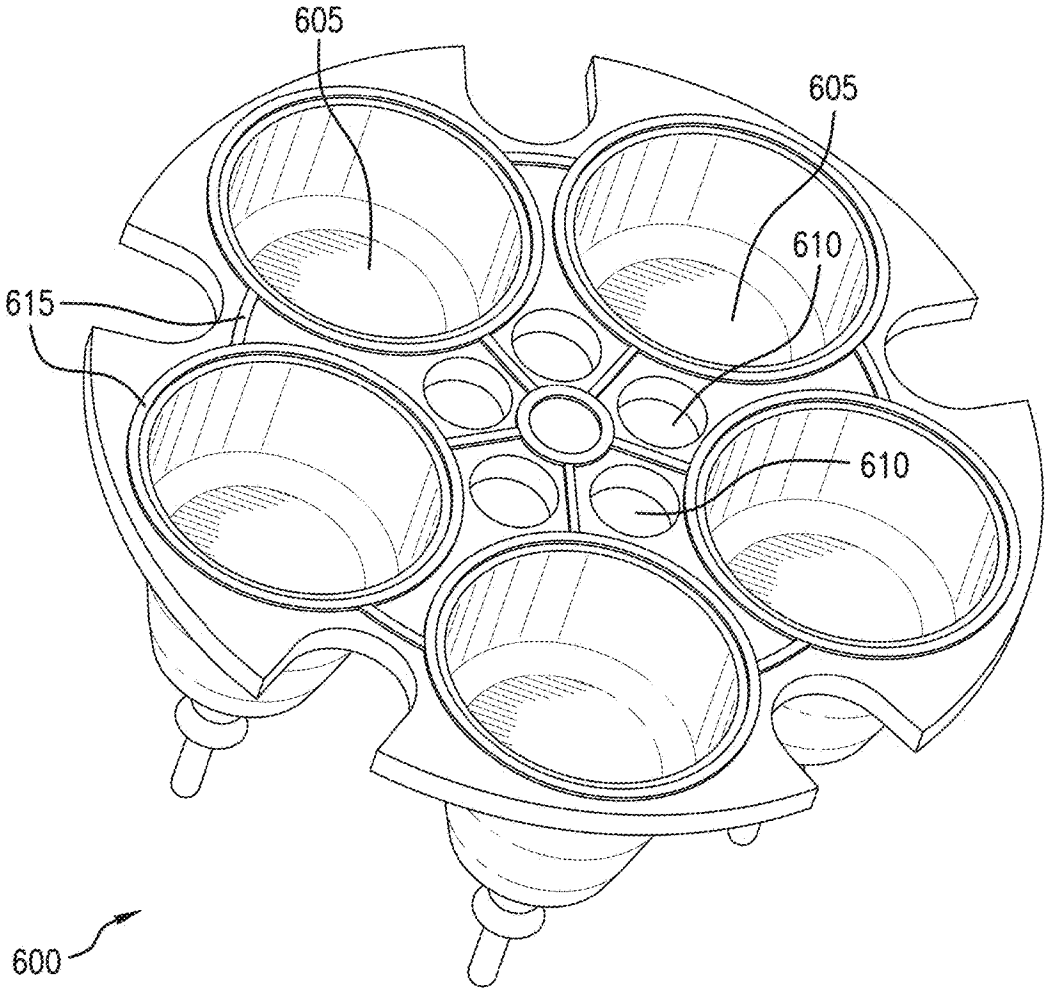
FIGS. 6A-6B depict an exemplary multi-piston diaphragm gasket.
Figure 6B:
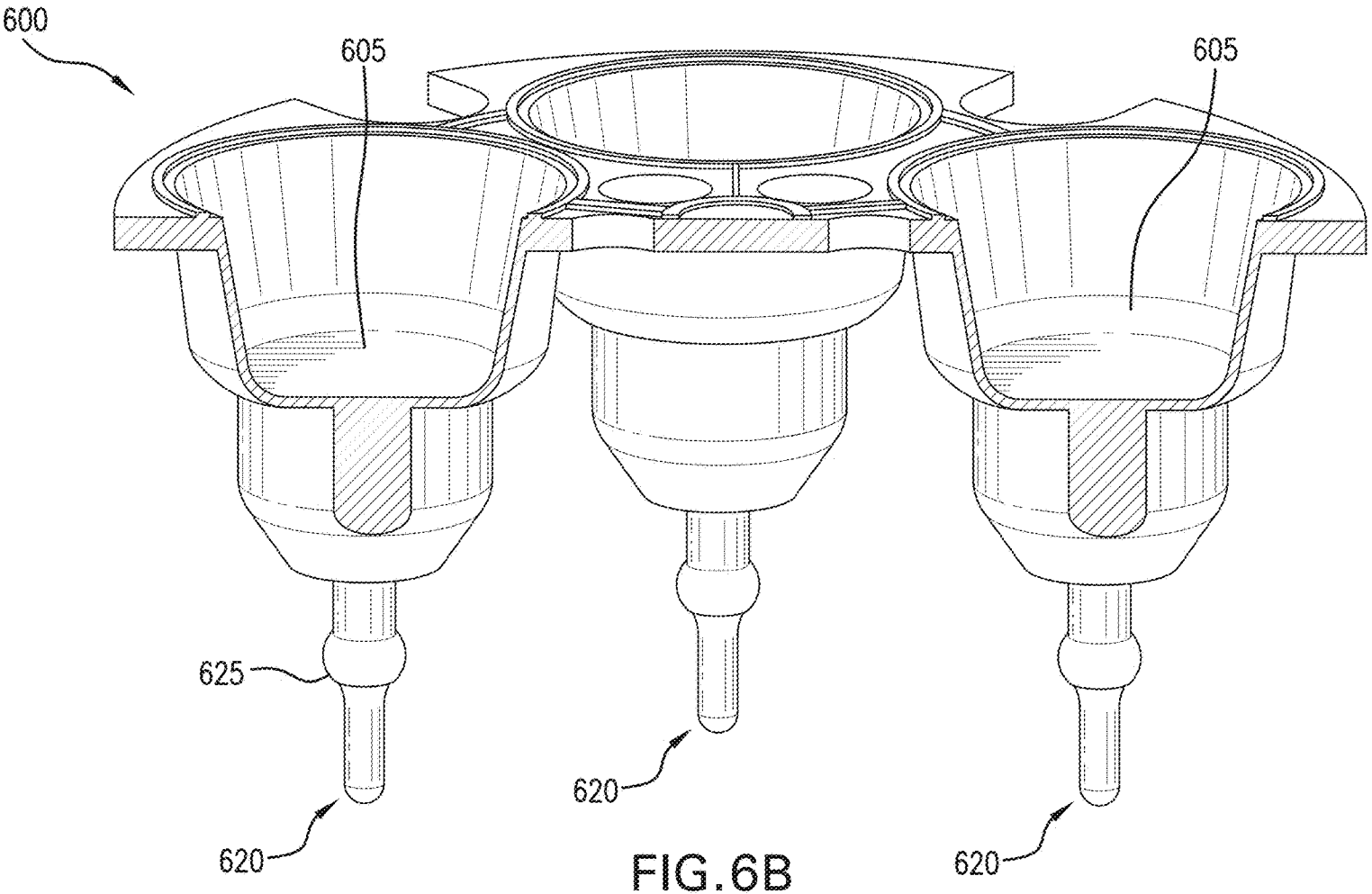

FIGS. 6A-6B depict an exemplary multi-piston diaphragm gasket. In FIGS. 6A-6B, an exemplary unitary piston assembly 600 includes five flexible pistons 605 and five intake flaps 610. Each of the five intake flaps 610 may correspond to one of the five flexible pistons 605. Each of the five intake flaps 610 may permit fluid flow from an intake manifold to the flexible piston 605 to which it corresponds. The intake flap 610 may seal cover a hole in a cylinder block. The hole may provide passage of fluid from an intake manifold. The intake flap 610, when covering the hole may prevent fluid in the piston from returning to the intake manifold. The unitary piston assembly 600 may be configured to interface with a valve plate having fluid channels. The valve plate may direct the fluid from the intake flap 610 to the corresponding flexible piston 605, for example. In some embodiments, sealing ridges 615 may provide fluid seals between the unitary piston assembly and the valve plate, for example.

In FIG. 6B, each flexible piston 605 has a flexible coupling member 620. The flexible coupling member 620 may include a securing member 625 to which a piston drive member may couple. In some embodiments, the flexible coupling members 620 may be flexible so as to permit the coupling members 620 to flex as the pistons are driven to accommodate any angular change of the piston drive coupler. In some embodiments flexible cylinder walls 630 may accommodate canting of a flexible piston 605. In various embodiments, the unitary piston assemblies 600 may be made of various materials. For example, in some embodiments, unitary piston assemblies 600 may include rubber. In some embodiments, the piston may be solid rubber and the cylinders may be this rubber membranes. An exemplary unitary piston assembly may be Ethylene Propylene Diene Monomer (EPDM) rubber. In some embodiments, unitary piston assemblies may include Hydrogenated Nitrile Butadiene Rubber (HNBR). In an illustrative embodiment, a unitary piston assembly may include Nitrile Butadiene Rubber (NBR). In some embodiments, Vulcanized Rubber (CR) may be included in a unitary piston assembly (e.g. neoprene and/or polychloroprene). In an exemplary embodiment, Carboxylated Nitrile Butadiene Rubber (XNBR) may be included in a unitary piston assembly.

Figure 7A:
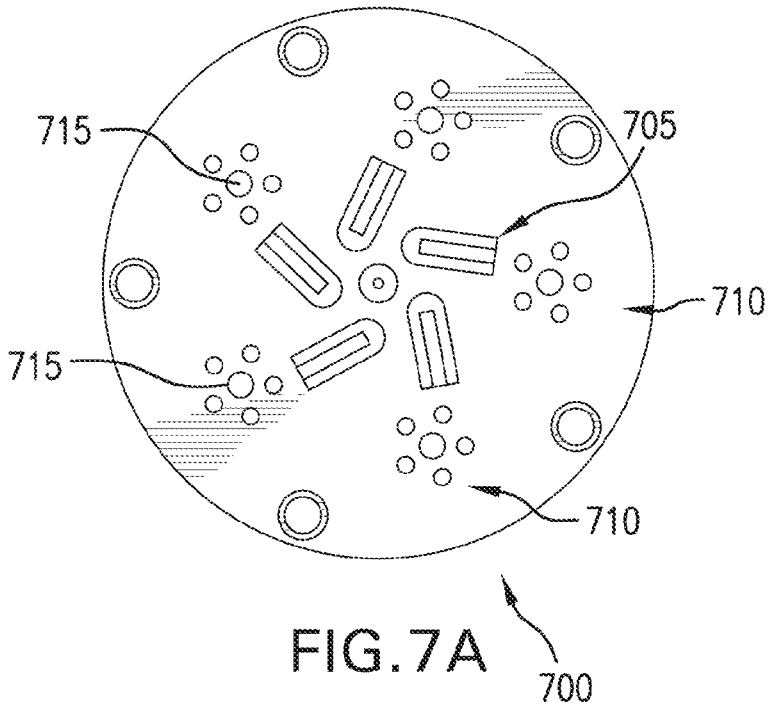
FIGS. 7A-7C depict an exemplary valve plate having exemplary intake and exhaust manifolds.
Figure 7B:
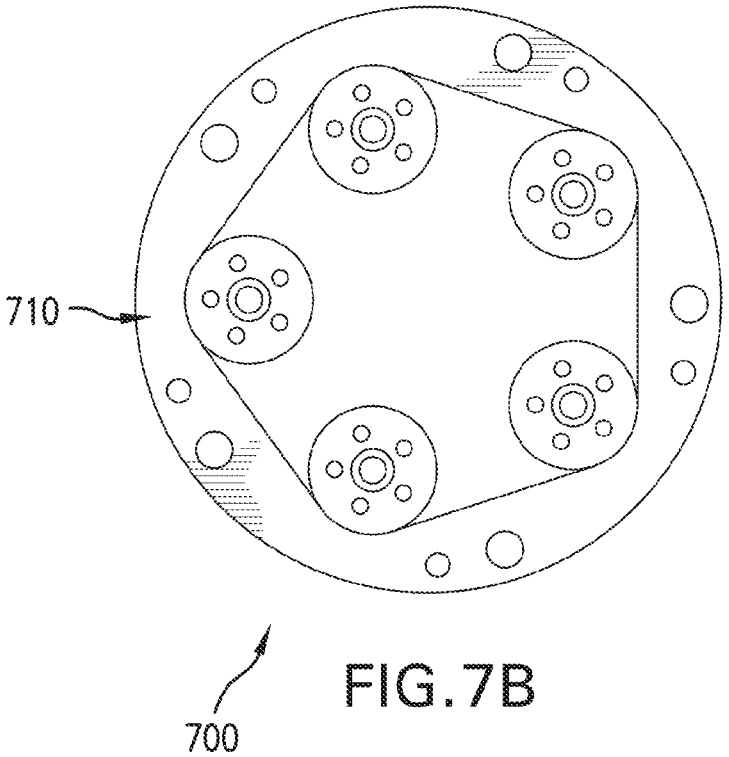
Figure 7C:
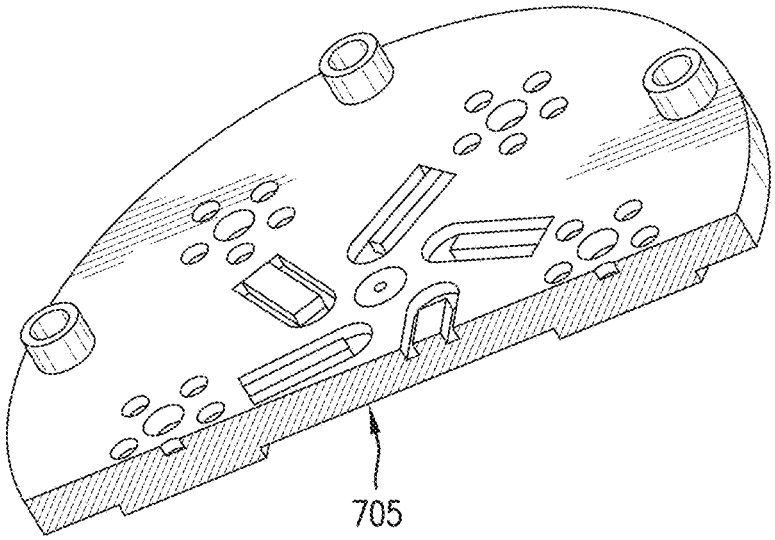

FIGS. 7A-7C depict an exemplary valve plate having exemplary intake and exhaust manifolds. In FIG. 7A an exemplary valve plate 700 is depicted from a piston interface side. The valve plate 700 is configured to interface with five radially symmetric pneumatic pistons. U-shaped intake channels 705 have been etched into a piston interface surface. The U-shaped intake channels 705 may be sized to facilitate laminar flow of the intake fluid, for example. A series of exhaust apertures 710 correspond to each pneumatic piston. An exhaust valve may cover each series of exhaust apertures 710 on an exhaust side of the valve plate, for example. In the depicted embodiment, a valve connection aperture 715 is centered within each series of exhaust apertures 710. The geometry of each exhaust aperture 710 may be conical, in some embodiments. For example, each exhaust aperture 710 may present a small opening on the piston side of the valve plate 700. An exhaust aperture 710 may grow in diameter as it traverses the valve plate 700. In some embodiments, an exhaust aperture 710 may present a larger opening on the exhaust side of the piston plate 700, for example. In some embodiments, the exhaust opening may be smaller than the piston opening of each exhaust aperture.

FIG. 7B depicts an exemplary valve plate 700 from an exhaust side. In some embodiments, exhaust channels may direct the fluid to an exit port. In some embodiments, an exhaust manifold may provide space for exhausting fluids. FIG. 7C depicts the exemplary valve plate 700 from a perspective view. In some embodiments, the channels may be configured to facilitate laminar flow and/or reduce noise.

Figure 8:
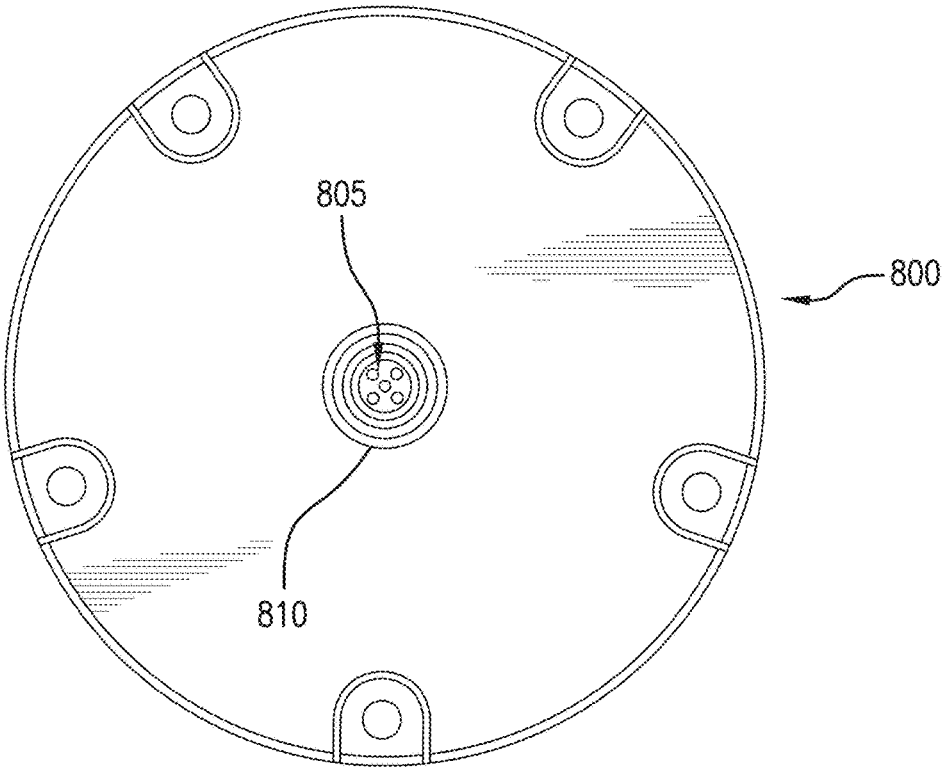
FIG. 8 depicts an exemplary exhaust cap for a pneumatic pump.

FIG. 8 depicts an exemplary exhaust cap for a pneumatic pump. In FIG. 8 an exemplary front housing 800 is shown from an exterior side plan view. In the depicted embodiment, an exemplary exhaust port 805 includes an exemplary exhaust lumen 810. In some embodiments, the exhaust lumen may be configured to facilitate laminar flow and/or reduce noise. In some embodiments, exhaust channels may be etched into an exhaust side of the exhaust cap 800.

Figure 9A:
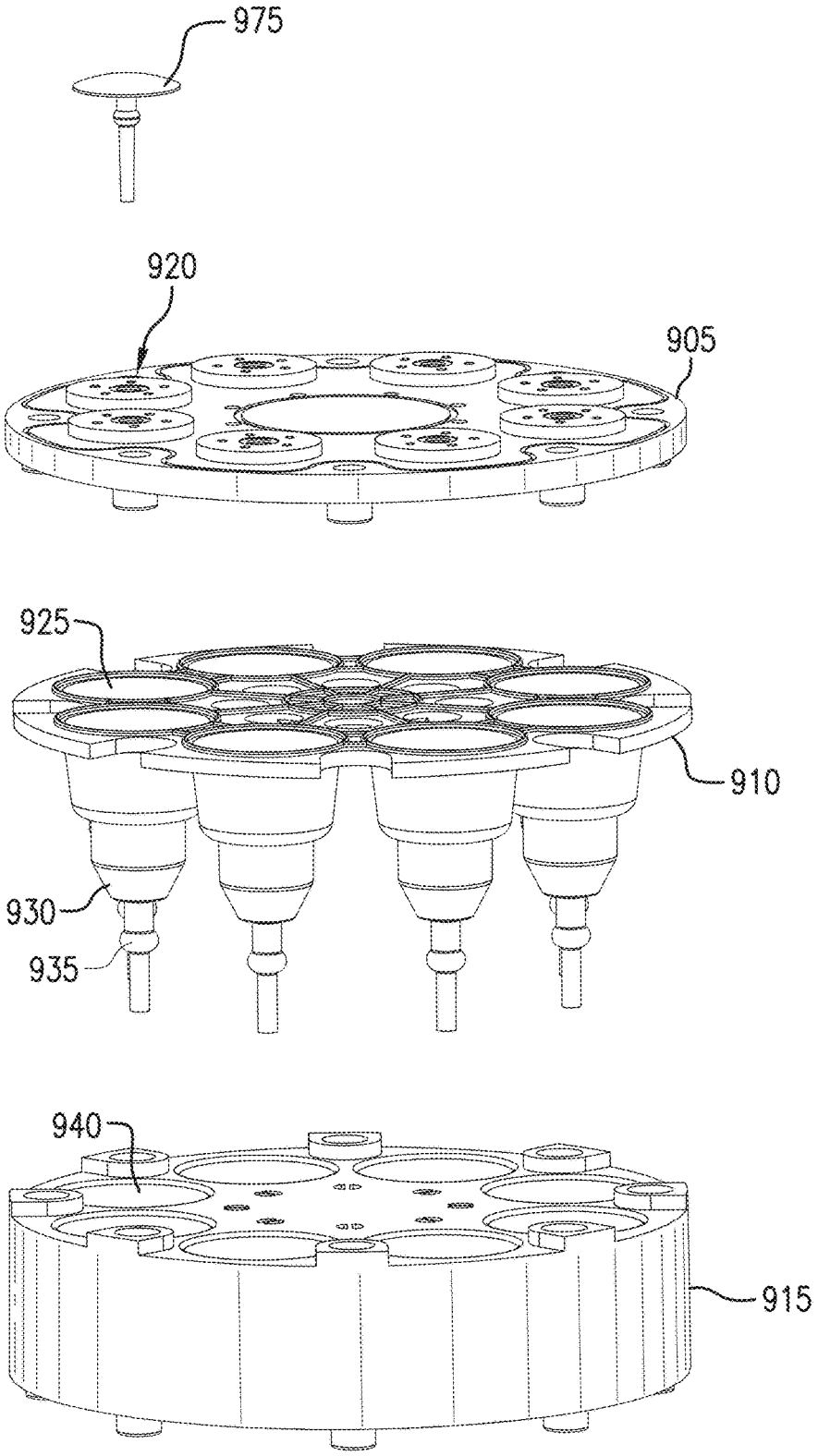
FIGS. 9A-9B depict exploded perspective and partial assembly view drawings of an exemplary air flow path for a canted diaphragm piston during a cycle of intake and exhaust.
Figure 9B:
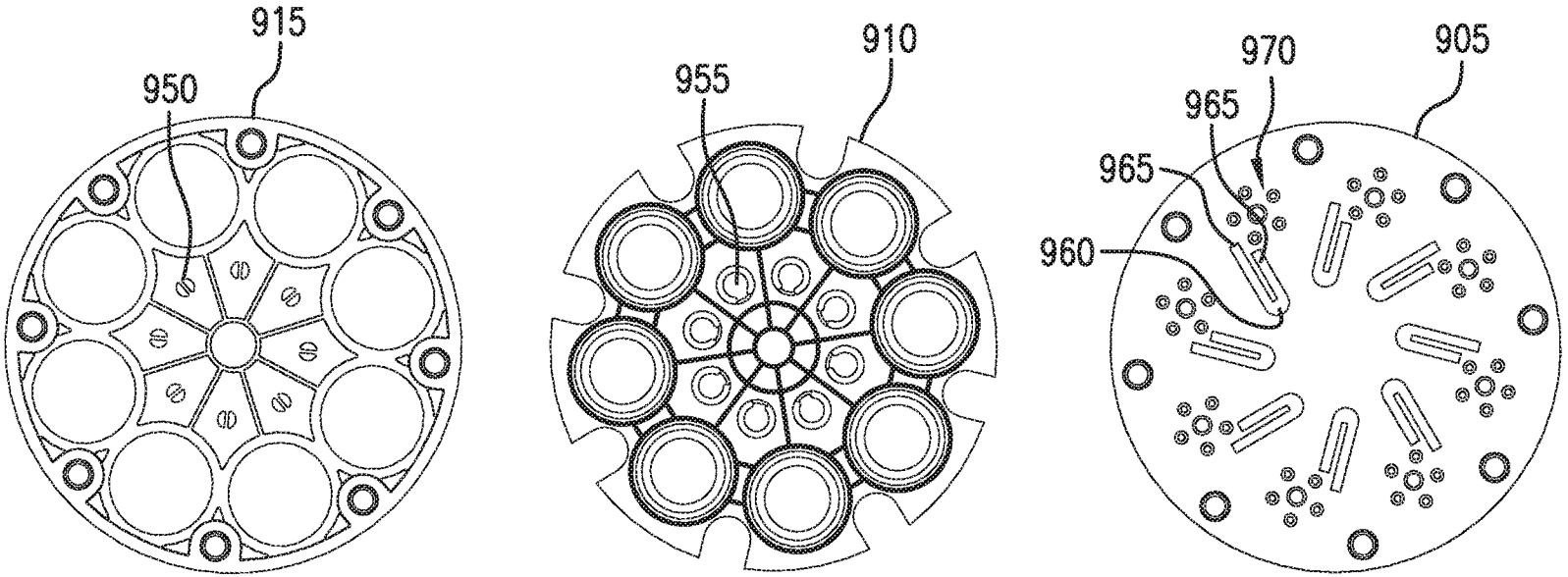

FIGS. 9A-9B depict exploded perspective and partial assembly view drawings of an exemplary air flow path for a canted diaphragm piston during a cycle of intake and exhaust. To simplify explanation, reference will be made to air flow path elements for a single piston. However, the pump includes a number of pistons, each of which may have a similar, separate or independent air flow path to the one to be described.

In the depicted figure, some components defining an air flow path through the pump include a valve plate 905, a diaphragm body 910, and a piston block 915. When assembled, the diaphragm body 910 is sealed on top by the valve plate 905, and from the bottom by the piston block 915.

On its top side, the valve plate 905 includes a number of apertures forming collectively an outlet port 920. On an upstroke, air is forced out of a piston chamber 925 in fluid communication with the ambient atmosphere, for example, through the apertures of the outlet port 920. The upstroke is effected by the wobble plate (not shown) driving the flexible diaphragm piston 930 upward, collapsing the volume of the chamber 925. The wobble plate effects this upstroke motion by its connection to a piston crank 935 extending from an exterior of the piston 930.

The diaphragm body 910 includes a flexible web of material that extends between each of the pistons 935. The flexible web of material provides sealing to isolate and separate the air flow paths used by each of the pistons. To support the diaphragm body 910 in the regions between the pistons, the piston block 915 provides substantially rigid structural support from below. The piston block 915 includes an aperture 940 through which the piston 930 and piston crank 935 are inserted during assembly.

To explain the air flow path on a down stroke of the piston 930, FIG. 9B depicts a top view of the piston block 915 and the diaphragm body 910, and a bottom view of the valve plate 905.

The piston block 915 includes a pair of inlet apertures 950 associated with the piston 930. During a down stroke, air is drawn into the piston via the inlet apertures 950. In the depicted embodiment, the inlet apertures 950 are divided by a bridge.

The flexible diaphragm body 910 is formed with a cut out configured to create a flap valve 955 aligned with the inlet apertures 950. During a down stroke, a pressure drop in the chamber 940 causes the flap valve 955 to lift as air is drawn in. During an upstroke, pressure increases in the chamber 940 causes the flap valve to seal the inlet apertures 950. The bridge between the apertures may support the flap valve 955, which may advantageously resist fouling the flap valve 955 and not allowing it to get sucked into the apertures 950.

A lip around the top of the piston 930 forms a seal with the bottom of the valve plate 905. In the depicted figure, the bottom surface of the valve plate 905 includes a shallow trench that provides fluid communication from the flap valve 955 into chamber 925. The trench by itself does not provide fluid communication to the top of the valve plate 905. In the depicted example, the trench includes a U-shape with a vertex aligned above the flap valve 955, and two ends 965 that terminate aligned above the chamber 925. During the down stroke, the chamber is sealed from fluid communication through the outlet ports 920 by a flap valve 975.

Figure 10:
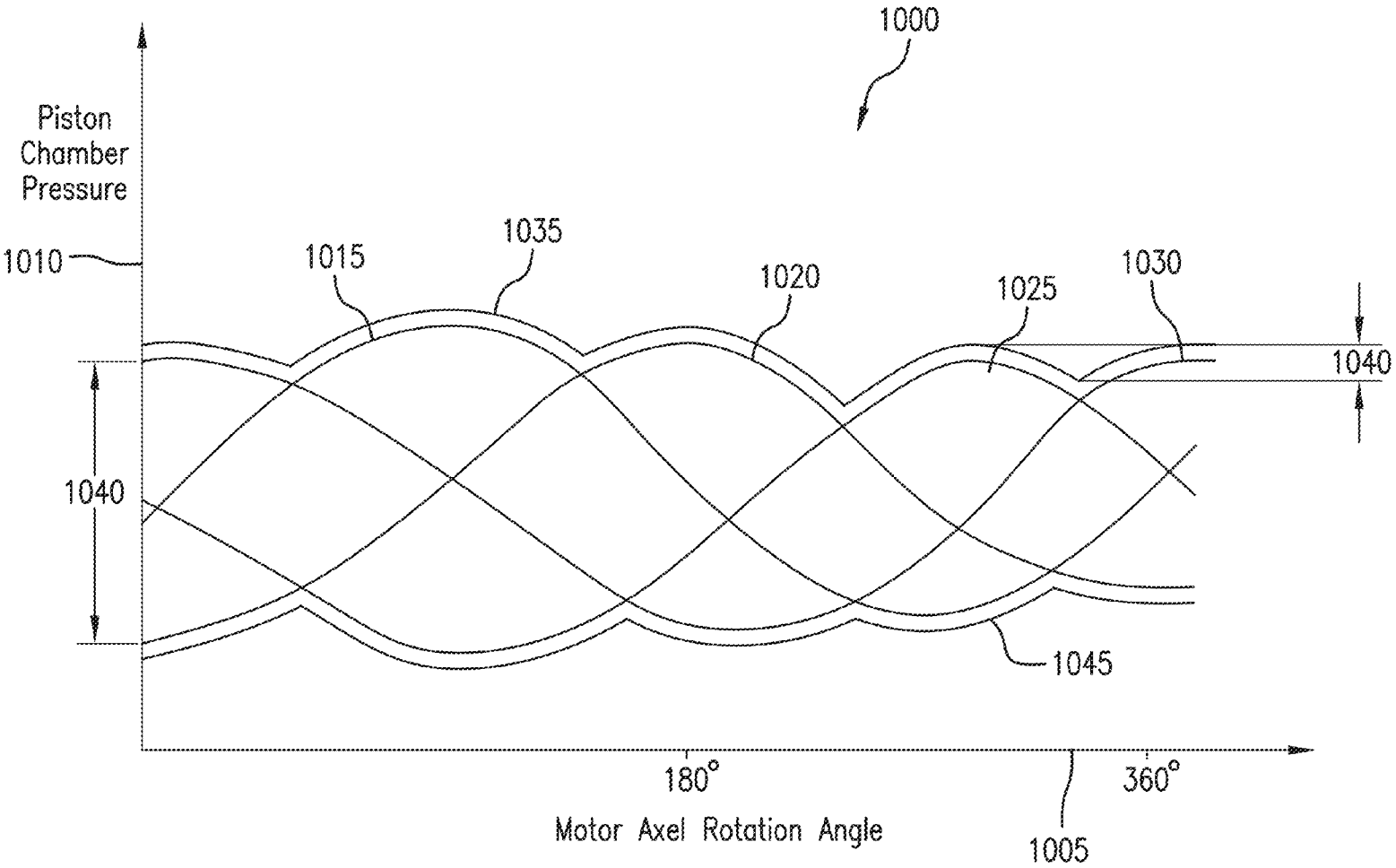
FIG. 10 depicts an exemplary graph of stroke positions of each of a plurality of phased pistons.

FIG. 10 depicts an exemplary graph of piston chamber pressure for each of a plurality of phased membrane pistons. In FIG. 10, a graph 1000 depicts a relation between piston chamber pressure and motor axle rotation angle. The graph 1000 has a horizontal axis 1005 that represents a motor axle rotation angle. The graph 1000 has a vertical axis 1010 that represents a membrane-piston chamber pressure. A relation 1015 of a first of four membrane pistons shows a chamber pressure that increases during an upstroke phase and decreases during a down-stroke phase. A second of four membrane pistons exhibits a similar relation 1020 but is phase delayed from the first relation 1015 by ninety degrees. A third of four pistons again exhibits a similar relation 1025 but is phase delayed from the first relation 1015 by 180°. A fourth of four membrane pistons again exhibits a similar relation 103 but is phase delayed from the first relation 1015 by 270°. An exhaust pressure may correspond to an envelope 1035 representative of the maximum pressure of the four membrane pistons. The periodic frequency of the envelope 1035 is four times the period of each of the relations 1015, 1020, 1025, 1030. The peak to peak amplitude of the envelope 1035 is much smaller than the peak to peak envelope of any of the four relations 1015, 1020, 1025, 1030. The amplitude of the peak-to-peak envelope of the exhaust pressure may correspond to a noise level associated with the exhaust port, for example.

An input pressure may correspond to an envelope 1045 representative of the maximum pressure of the four membrane pistons. The periodic frequency of the envelope 1045 is four times the period of each of the relations 1015, 1020, 1025, 1030. The peak-to-peak amplitude of the envelope 1045 is much smaller than the peak-to-peak envelope of any of the four relations 1015, 1020, 1025, 1030. The amplitude of the peak-to-peak envelope of the input pressure may correspond to a noise level associated with the input port, for example. In some embodiments, the input port may present an input pressure that is lower than the ambient pressure. In some embodiments, an exemplary pneumatic pump may be configured as a vacuum pump, for example. As the number of membrane pistons increases, the periodic frequencies of both input and exhaust pressures may increase. As the number of membrane pistons increases, the peak-to-peak amplitude of the input and exhaust port pressures may decrease. In some embodiments, the noise behavior of the pump may correlate to the number of membrane pistons.

Figure 11A:
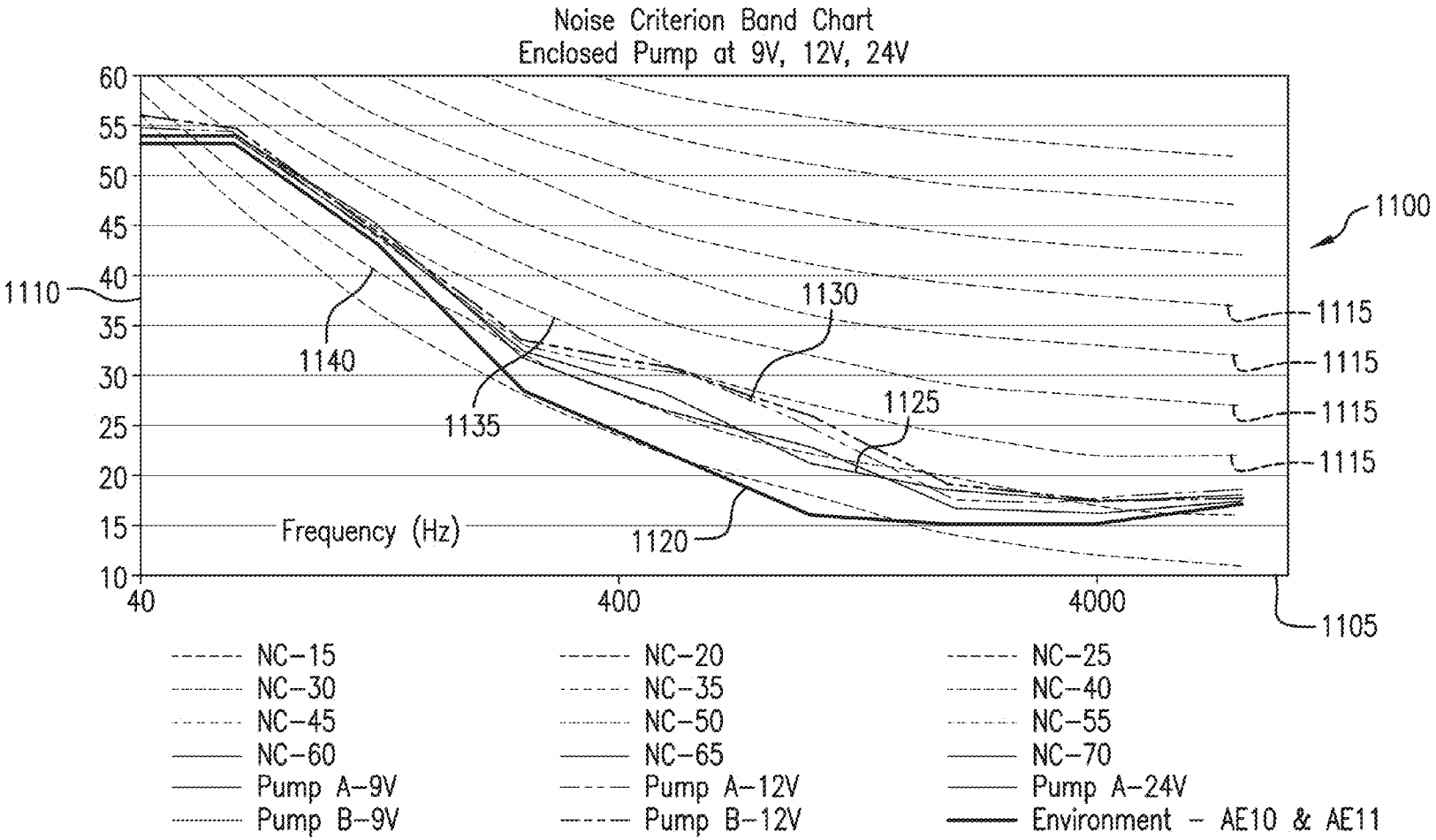
FIGS. 11A-11D depict graphs of experimental results of pneumatic pumps that have canted off-axis membrane drivers.

FIGS. 11A-11D depict graphs of experimental results of pneumatic pumps that have oscillating umbrella linkages that produce a transitive wave motion. In FIG. 11A, a graph 1100 has a horizontal axis 1105 that represents frequency. The graph 1100 has a vertical axis 1110 that represent acoustic spectral noise power. A series of reference noise spectrums 1115 are traced upon the graph 1100. These reference noise spectrums 1115 correspond to an industry standard NC (noise criterion) noise levels for rating indoor noise levels. Each of the reference noise spectrums 1115 reflect an industry belief that a person tolerates more noise at lower frequencies than the person tolerates at higher frequencies. This industry belief is reflected in the monotonic negative slope of each of the reference noise spectrums 1115.

The measured noise spectrum 1120 represents a background ambient noise of the testing chamber. The measured noise spectrum 1125 corresponds to a pneumatic pump operating with nine volts applied to a pump motor. The measured noise spectrum 1130 corresponds to a pneumatic pump operating with twelve volts applied to a pump motor. Note that the twelve volt operating pump produces a noise spectrum that is less than or equal to the noise reference level NC-25 1135 at nearly every frequency measured. Also note that the noise spectrum corresponding to a nine volt operating pneumatic pump is less than or equal to the noise reference level NC-20 1140 at nearly every frequency measured. The tested pumps operating at both nine volts and twelve volts each have a series of pump membranes that are driven by an oscillating umbrella linkage. The oscillating umbrella linkage may be coupled to a drive motor in an off-axis canted fashion. This off-axis canted coupling may produce a transitive wave motion in the oscillating umbrella linkage. The transitive wave motion may produce a series of phased drive motions to a corresponding series of pump membranes.

Figure 11B:
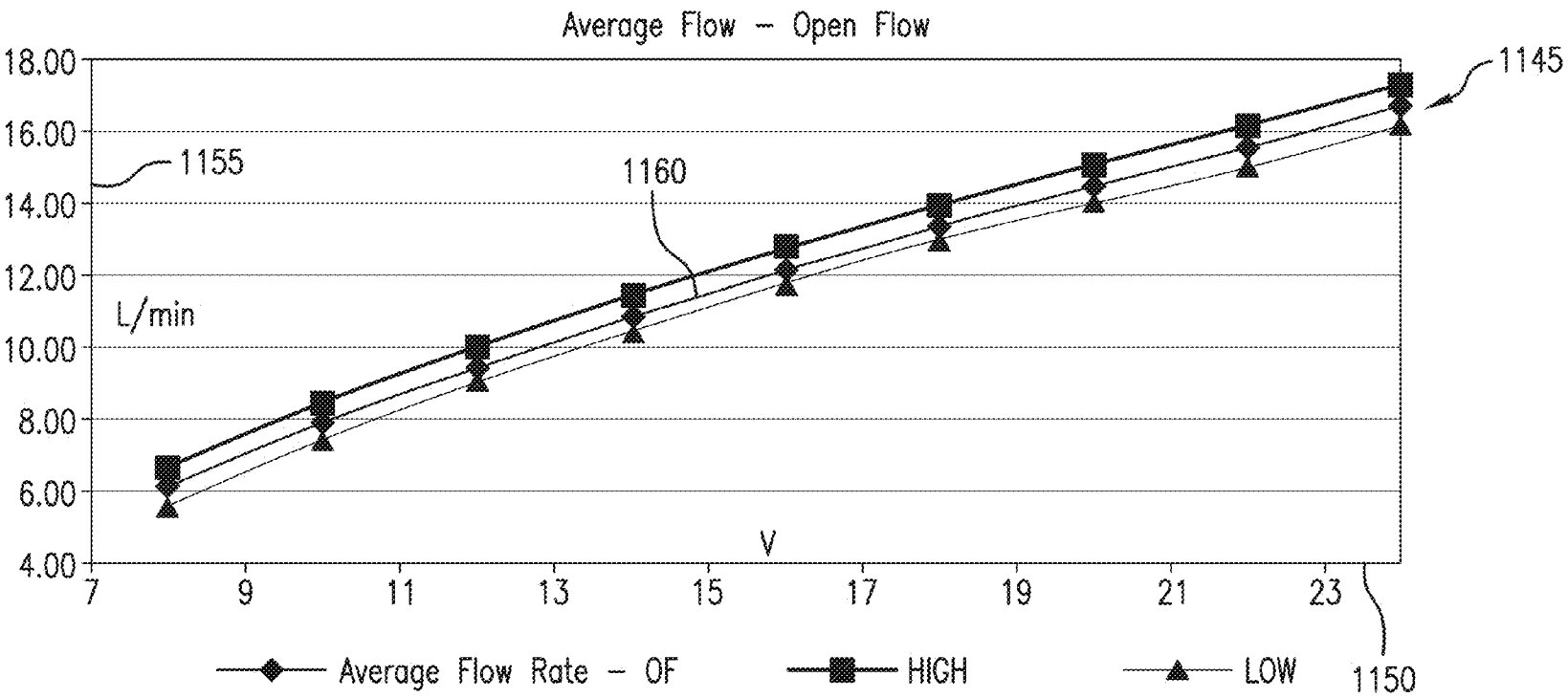

FIG. 11B depicts a graph of a flow rate of a pneumatic pump having an oscillating umbrella linkage versus an applied voltage to a drive motor. In FIG. 11B, a graph 1145 has a horizontal axis 1150 that represents voltage. The graph 1145 has a vertical axis 1155 that represents flow rate. The relation 1160 represents an average of measured flow rates of umbrella linkage driven pneumatic pumps as a function of applied voltage to a pump motor. This relation 1160 was performed with an exhaust port at atmospheric pressure.

Figure 11C:
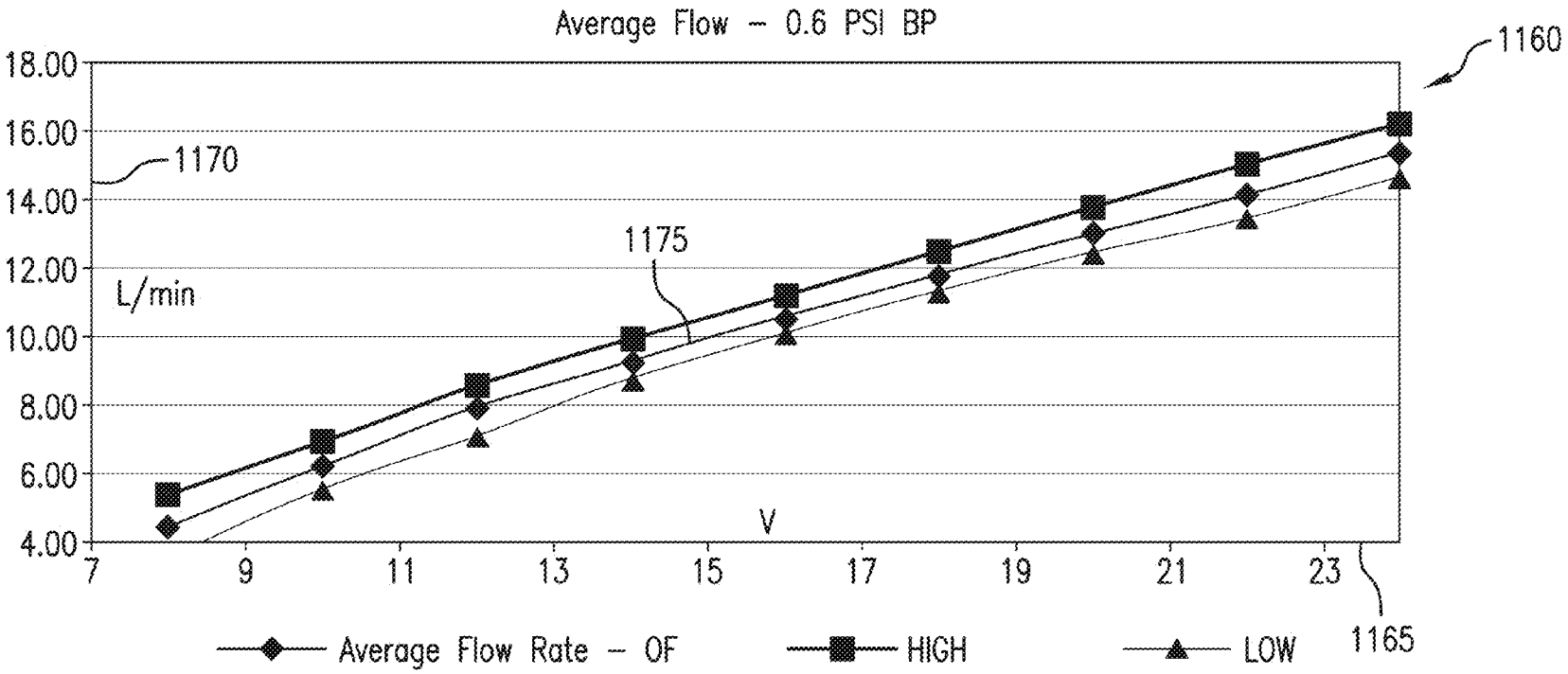

FIG. 11C depicts a graph of a flow rate of a pneumatic pump having an oscillating umbrella linkage versus an applied voltage to a drive motor. In FIG. 11C, a graph 1160 has a horizontal axis 1165 that represents voltage. The graph 1160 has a vertical axis 1170 that represents flow rate. The relation 1175 represents an average of measured flow rates of umbrella linkage driven pneumatic pumps as a function of applied voltage to a pump motor. This relation 1175 was performed with an exhaust port at a 0.6 PSI.

Figure 11D:
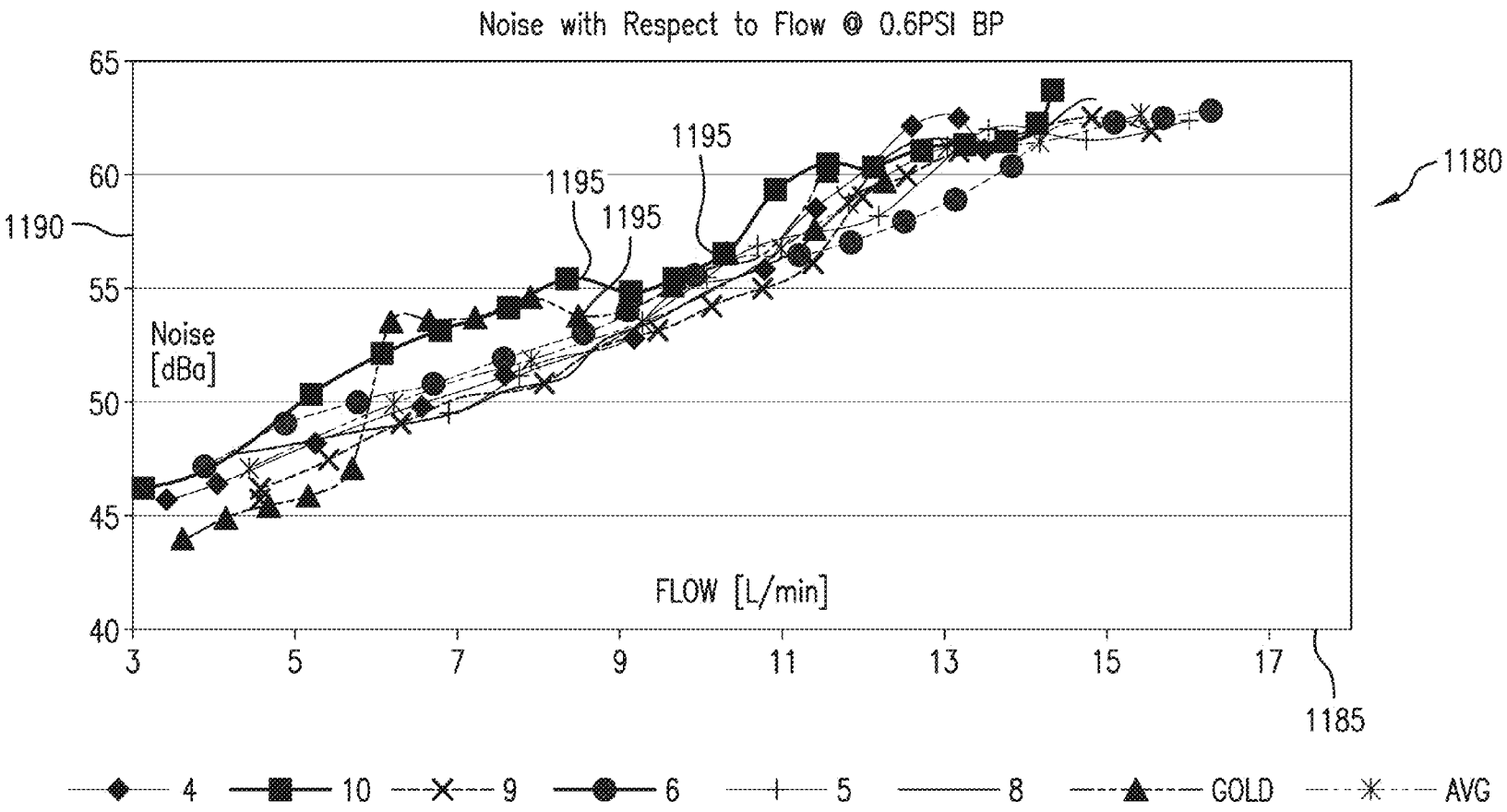

FIG. 11D depicts a graph of a flow rate of a pneumatic pump having an oscillating umbrella linkage versus an applied voltage to a drive motor. In FIG. 11D, a graph 1180 has a horizontal axis 1185 that represents flow rate. The graph 1180 has a vertical axis 1190 that represents noise. The relations 1195 depict measurements of noise vs. flow rate of umbrella linkage driven pneumatic pumps as a function of applied voltage to a pump motor. The relations 1195 were performed with an exhaust port at a 0.6 PSI.

FIGS. 12A-15B depict various views of exemplary components of an embodiment of a pneumatic pump.

Figure 12A:
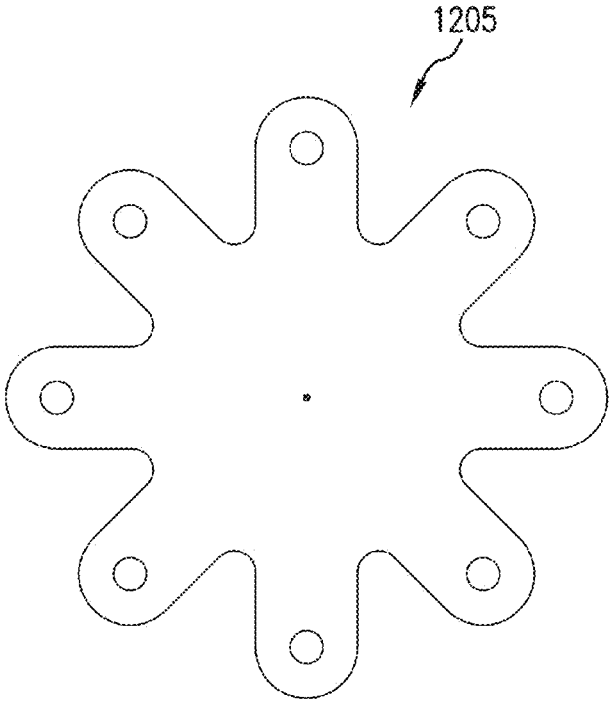
FIGS. 12A-15B depict various views of exemplary components of an embodiment of a pneumatic pump.
Figure 12B:
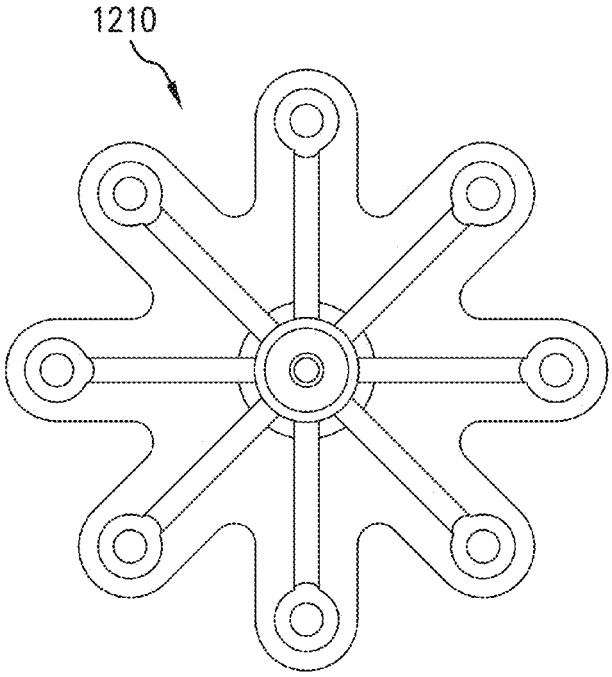
Figure 12C:
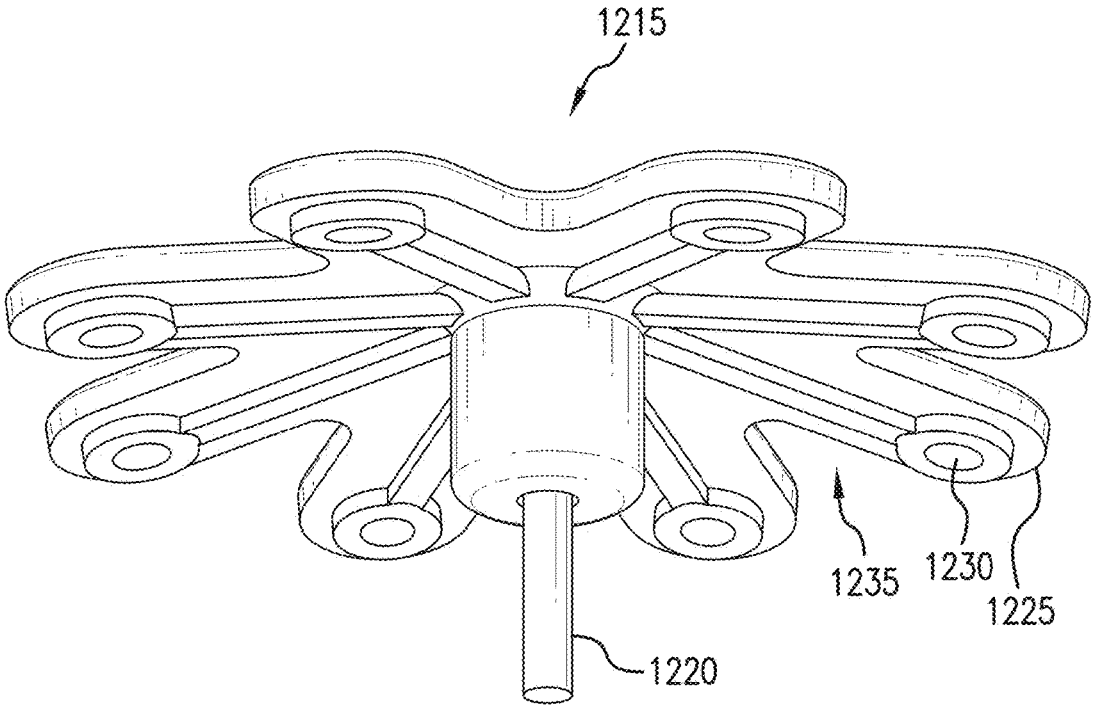

FIGS. 12A-12C depict a top view 1205, bottom view 1210, and perspective view 1215 of an exemplary wobble plate. The wobble plate 1215 includes a shaft 1220, 8 radial arm members 1225, each having an attachment aperture 1230 at a distal end thereof. In this embodiment, a notch 1235 lies between each of the distal ends of adjacent radial arm members 1225.

Figure 13:
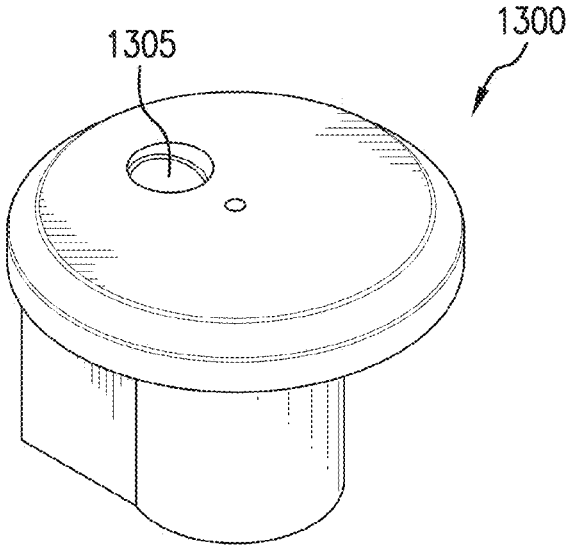

FIG. 13 depicts a perspective view of an exemplary spinner 1300. In the top of the spinner 1300 lies an aperture into a shaft receptacle 1305. An upper portion of the spinner 1300 rests on a cylindrical base and an adjacent intersecting block member.

In various embodiments, the spinner 1300 may provide a nutating motion profile for an umbrella linkage or wobble plate, such as the wobble plate 1215, for example. When coupled to a drive shaft on a proximal face, with the wobble plate shaft (e.g., shaft 1220) inserted into the eccentric shaft receptacle, the spinner 300 may impart a nutating motion to the wobble plate in response to rotation of the drive shaft about a drive axis of rotation. In various implementations, the longitudinal axis of the wobble plate shaft may be substantially offset and canted with respect to the drive axis of rotation.

Figure 14:
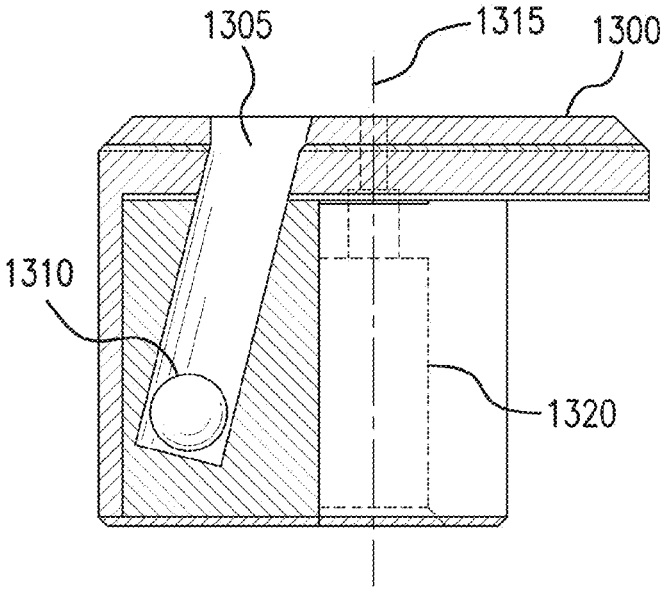

FIG. 14 shows a side cross-section view of the spinner 1300. The spinner 1300 is configured to be rotated by a motor around an axis of rotation 1305 that extends through the cylindrical base of the spinner 1300. The shaft receptacle is canted and off-axis relative to an axis of symmetry of the cylindrical portion. In the depicted example, the shaft receptacle 1305 extends into the intersecting block portion. Inside and at a bottom of the shaft receptacle 1305 lies a ball bearing 1310. In various embodiments, this ball bearing 1310 may substantially reduce rotational friction with the shaft of a wobble plate, such as, for example, the shaft 1215 as described with reference to FIG. 12.

In some embodiments, the ball bearing 1310 may be a steel bearing ball in the bottom of the eccentric hole. The ball may reduce wear between shaft end and a bottom of the eccentric hole.

Figure 15A:
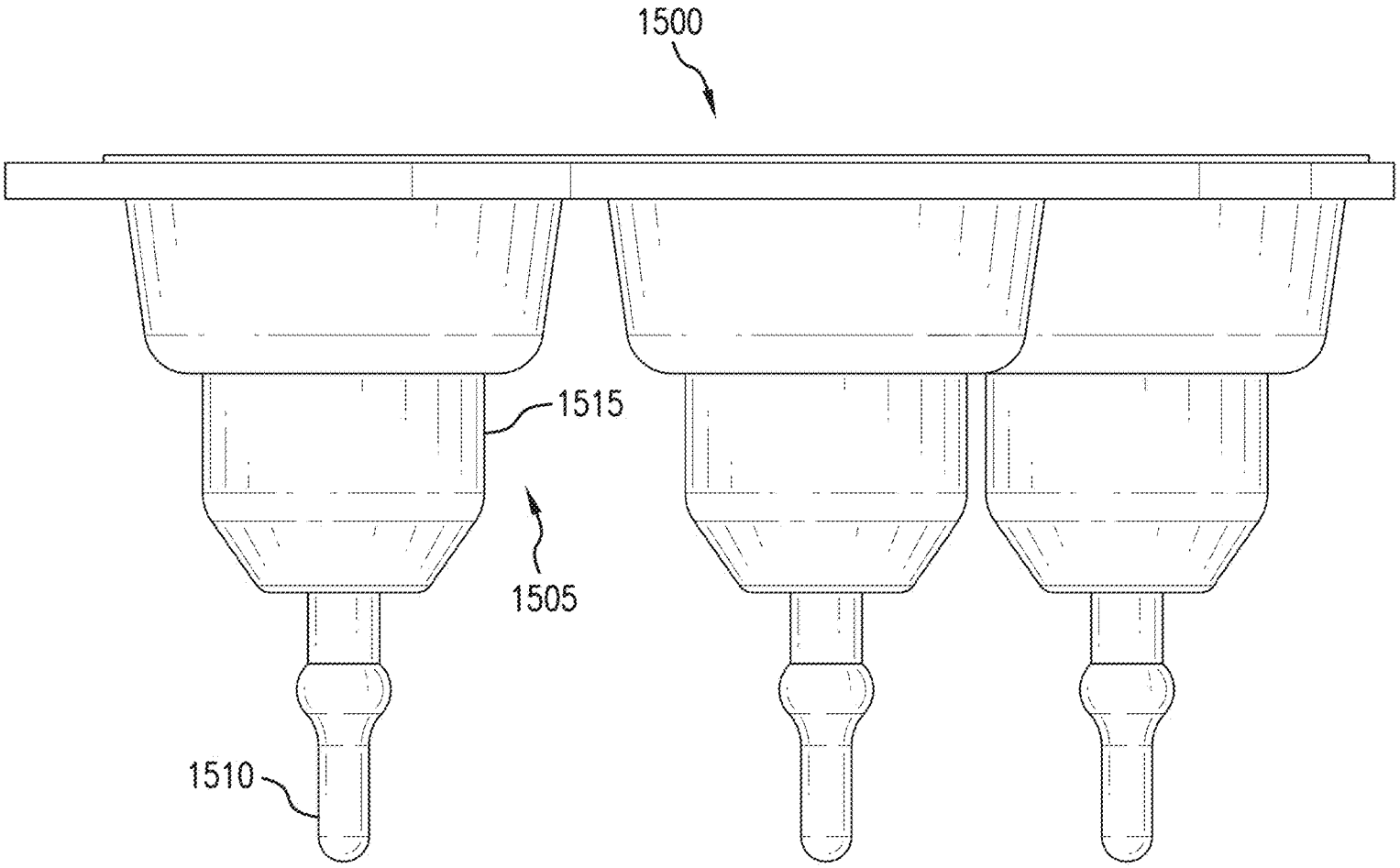
Figure 15B:
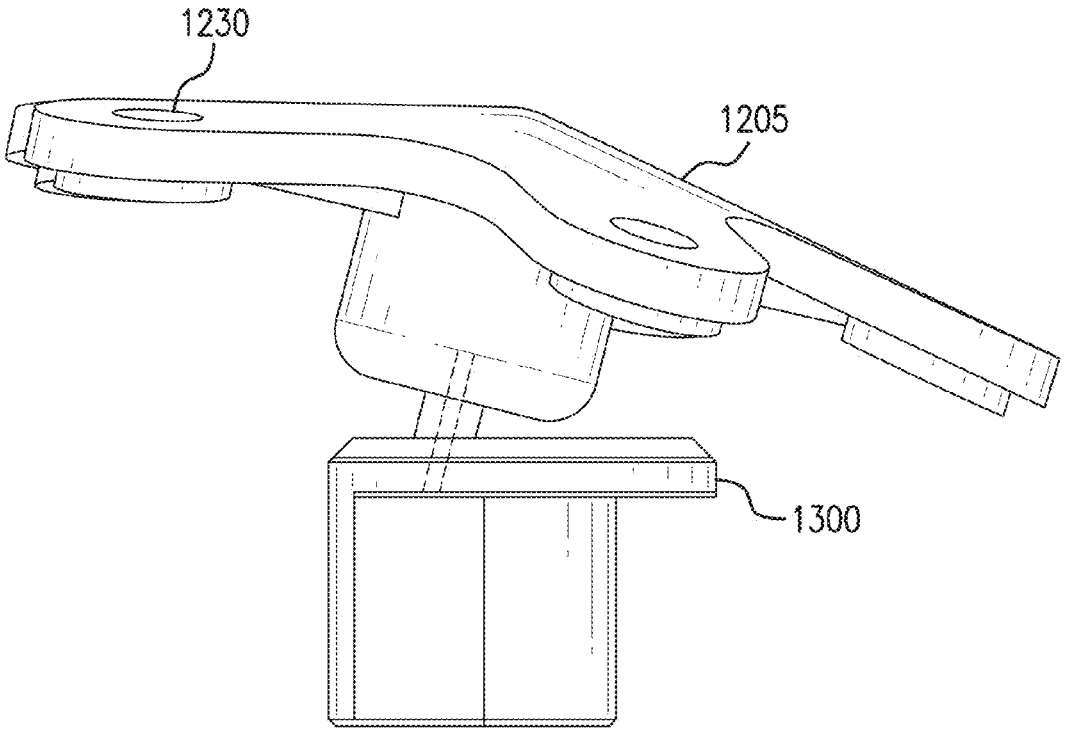

FIGS. 15A-15B depict a partially assembled side view of exemplary components of a pneumatic pump. As depicted, a partial set of three pliable pistons 1500 are shown disconnected from a driver assembly that includes the wobble plate 1205 assembled with its shaft operably coupled to the spinner 1300. The set of pistons 1500 includes three pistons 1505. Each of the pistons 1505 includes a pliable chamber wall 1515 to contain a volume of air to be pumped, and a piston coupling member 1510 that extends from the chamber wall 1515. In operation, each of the piston coupling members 1510 may be connected to a corresponding attachment aperture 1230 of the wobble plate 1205.

In some embodiments, assembly may include inserting the piston coupling member 1510 of the rubber diaphragm forming chamber walls 1515 into the corresponding attachment aperture 1230 at each end of wobble plate radial arms. For example, the wobble plate 1205 may be pressed onto the shaft 1220 that rests on the ball 1310 in the eccentric hole 1305.

In an illustrative example, the spinner 1300 is a small piece that may be coupled to an electric motor. The shaft receptacle 1305 may be an eccentric hole going down from the top surface of the spinner 1300, and piercing the surface off center. In some embodiments, the shaft receptacle 1305 receives a steel shaft that is fixed rotationally by its attachment to the piston coupling members 1510 of the pumping diaphragm via a plastic wobble plate 1205. In various examples, as the spinner 1300 rotates with the motor shaft 1220, the eccentric shaft 1220 and attached wobble plate 1205 tilt back and forth, moving the wobble plate radial arm members 1225 and/or their corresponding attachment apertures 1230 in a roughly vertical motion.

Figure 16A:
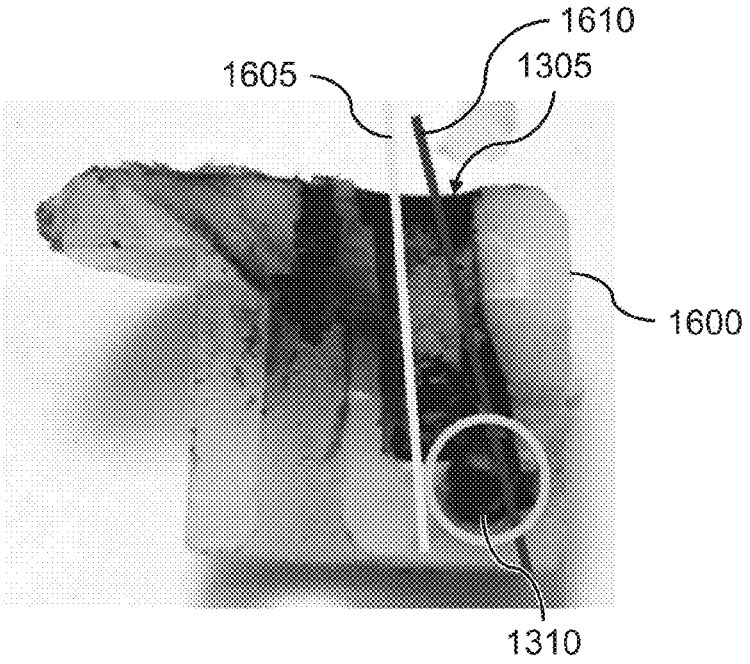
FIGS. 16A-16B depict views of components revealing exemplary failure modes due to wear.
Figure 16B:
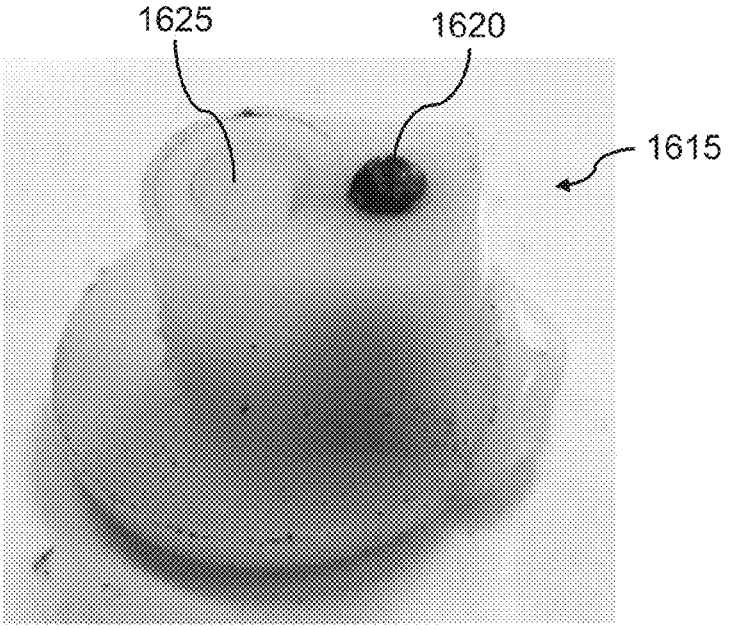

FIGS. 16A-16B depict views of components revealing exemplary failure modes due to wear. Experiments have demonstrated that some potential failure modes may occur in the piece called the "spinner." The spinner is responsible for translating rotational motion of the motor into the pumping action that moves the cylinders. It is believed that, in part, two failure modes relate to the pressures within the diaphragm cylinders. Each cylinder has a dedicated intake and exhaust port, allowing the pressure within each cylinder to be (partially) independent of pressure in other cylinders.

Some failure modes may be described in terms of forces. One exemplary force is the force of the shaft pressing on the ball at the bottom of the hole. This force includes a component directed along the central axis of the eccentric hole. A second force is a torsional force, pressing the bottom of the shaft into the eccentric hole wall on the side nearest the motor shaft. At the same time, it presses the shaft where it exits the spinner into the eccentric hole wall on the side away from the motor shaft. It is believed that the friction-induced heat may soften the spinner's material and allows the shaft to dig into the hole sidewalls and allows the ball to migrate through the softened material until it is out of position and no longer supporting the shaft.

In an experiment, pumps on test are measured periodically to track performance. Tests are run under standard operating conditions as well as under accelerated life testing conditions. A failure may be determined as the pump's output falling below a flow rate threshold, or a specified drop in pump efficiency.

FIG. 16A depicts one experimental result showing a close-up of spinner cut open after failure. A yellow line 1605 shows the axis of the original eccentric hole (with ball bearing still in position 1310, indicated by drawn circle). A red line 1610 shows the axis of the hole after the shaft wore into the plastic.

FIG. 16B shows another experimental result. In this example, the ball migrated through the spinner 1615 plastic. This picture shows the ball bearing 1620 projecting out of the spinner's bottom surface, adjacent to a motor shaft receptacle 1625.

FIGS. 17-20 depict optimization criteria for design of various embodiments of a pneumatic pump.

It is believed that some spinners may experience one or the other of these wear patterns, while some may experience both. Both cases result in the eccentric shaft shifting to a position that provides an attenuated pumping motion and thus attenuated output. In some embodiments, one exemplary objective may include optimization to manage excess heat and wear created during operation to allow the pump to operate for longer periods before failing.

Figure 17:
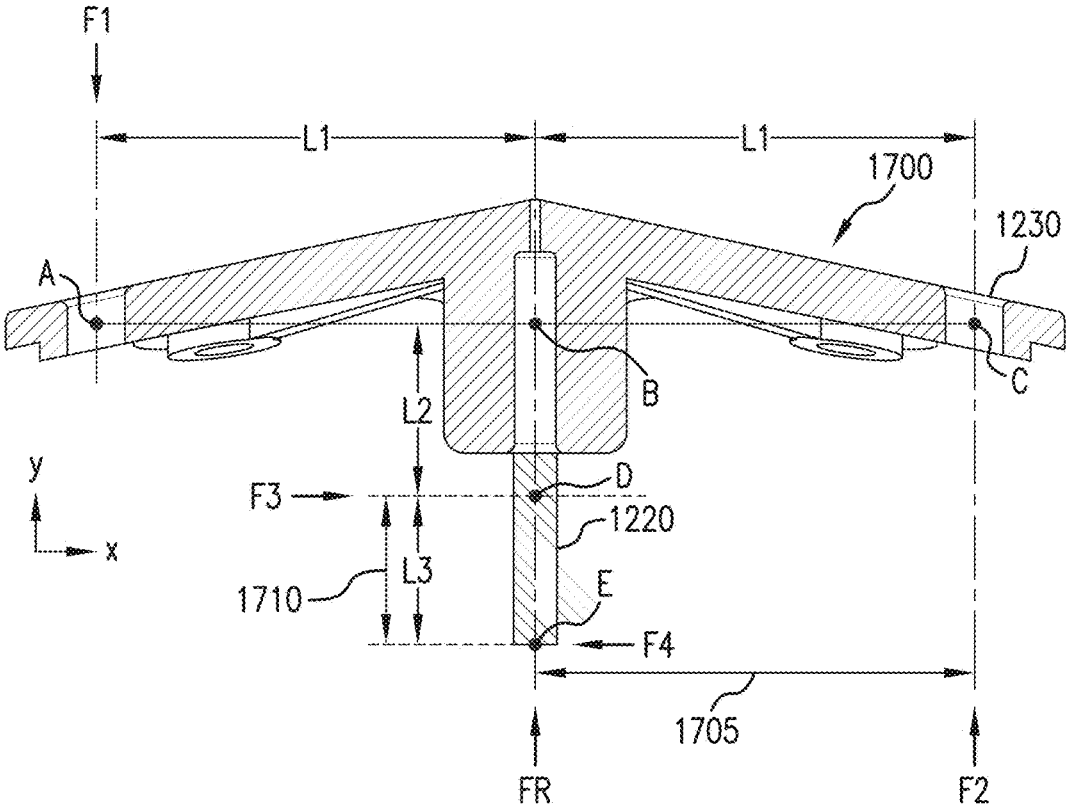

FIG. 17 depicts an advantageous optimization to substantially reduce wear in the spinner due to the shaft 1220. A wobble plate assembly 1700 includes the shaft 1220 insertable into the spinner's eccentric shaft receptacle 1305. The wobble plate assembly 1700 further includes the attachment apertures 1230 as described with reference to FIG. 12. A moment arm (L1) 1705 is defined by a distance from the axis of the shaft 1220 to a centerline parallel to the shaft 1220 and passing through a center of one of the attachment apertures 1230. A moment arm L3 1710 is defined by a distance along the axis of the shaft 1220 for which the shaft 1220 is inserted into the spinner's eccentric shaft receptacle 1305.

An exemplary optimization criteria is to substantially equalize the magnitudes of the forces F3 and F4, at the respective proximal and distal ends of the portion of the shaft 1220 inserted into the spinner shaft receptacle 1305.

Certain wear failure modes are a function of the moment arm applied to the shaft 1220 in the spinner shaft receptacle 1305. An exemplary optimization method involves calculating the sum of the moments about point D, which lies along the axis of the shaft and in a plane that is tangent to a top surface of the spinner at the aperture of the shaft receptacle 1305. The moment sum about point D is directly proportional to the dimensionless ratio of L1/L3. As such, the moment sum about point D may be minimized by minimizing L1 and/or maximizing L3 within available practical limitations.

FIG. 18 depicts exemplary tables 1800 that show calculated moment arm lengths 1805 at various lengths of spinner depth 1810 for a pump that has 5, 8 and 9 cylinders. It is believed that calculated values between about 1.5 and about 1.75 are in an optimal range, such as those circled as 1815, 1820, and 1825. An L1/L3 ratio below about 1.50 may further mitigate wear; however, other considerations may reduce the benefits of further reductions in L1/L3 below, for example, about 1.5 to reduce wear. For example, providing L1/L3 above about 1.5 may advantageously yield efficient use of space by limiting L3 so that the spinner need not become unnecessarily large or impractical. An L1/L3 ratio above about 1.75 have exhibited premature failures in experimental testing.

FIGS. 19A-19C depict an exemplary table 1900 that shows calculated moment arm lengths 1905 at various lengths of spinner depth 1910 for a pump. In the depicted example, calculated values between line segments A,B are in an optimal range. In order of decreasing optimization, a second desired range exists between line segments A, C, followed by a range between line segments B and D and then between line segments D, E. Sub-optimal performance may be expected for values of L1/L3 that appear in the areas represented by cells between line segments C, G and between line segments E, F.

Figure 20:
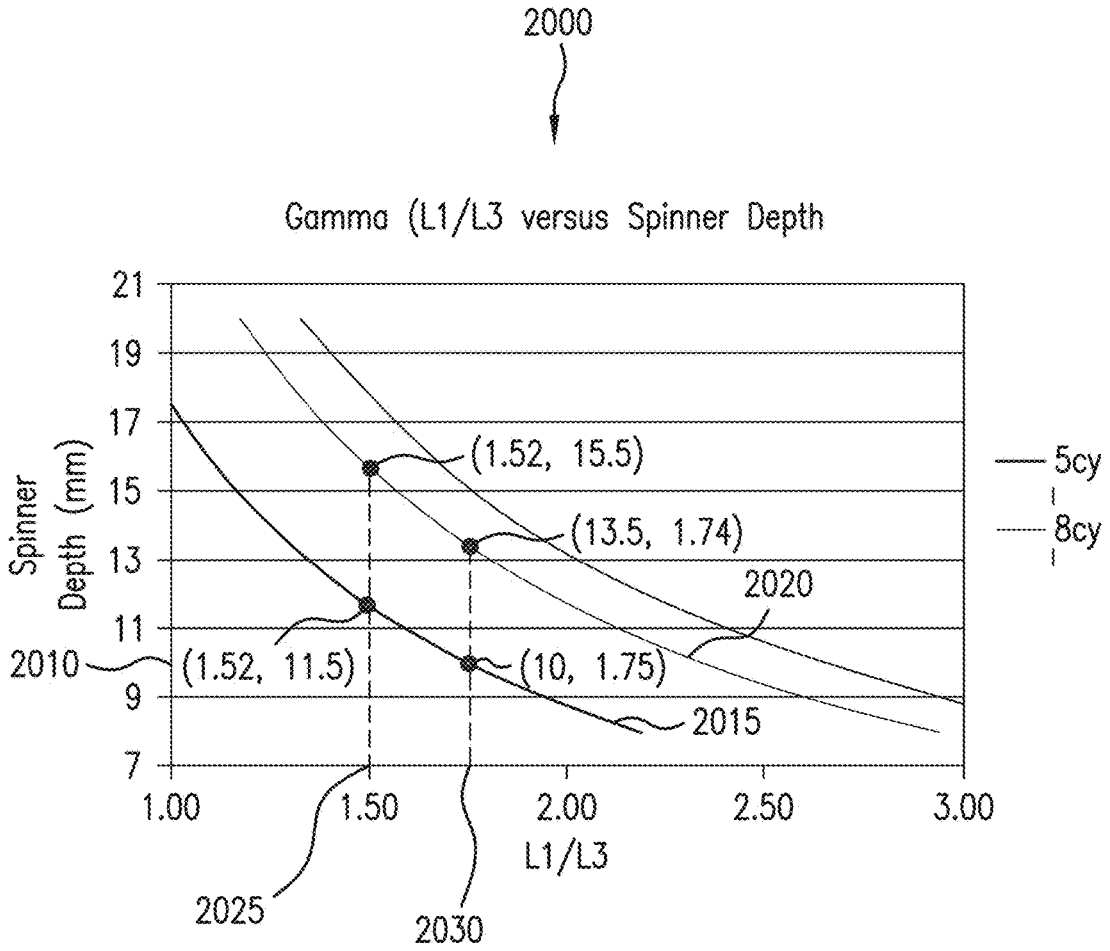

FIG. 20 is a plot of an exemplary optimization range of L1/L3 to mitigate wear. A plot 2000 includes the ratio L1/L3 along an X-axis 2005, and spinner depth along a Y-axis 2010. A plot of values 2015 represents a pump with 5 pliable cylinders driven by a canted off-axis piston driver. A plot of values 2020 represents a pump with 8 pliable cylinders driven by a canted off-axis piston driver. As shown, an optimal range exists between values of L1/L3 between about 1.5 at 2025 and about 1.75 at 2030.

Figure 21:
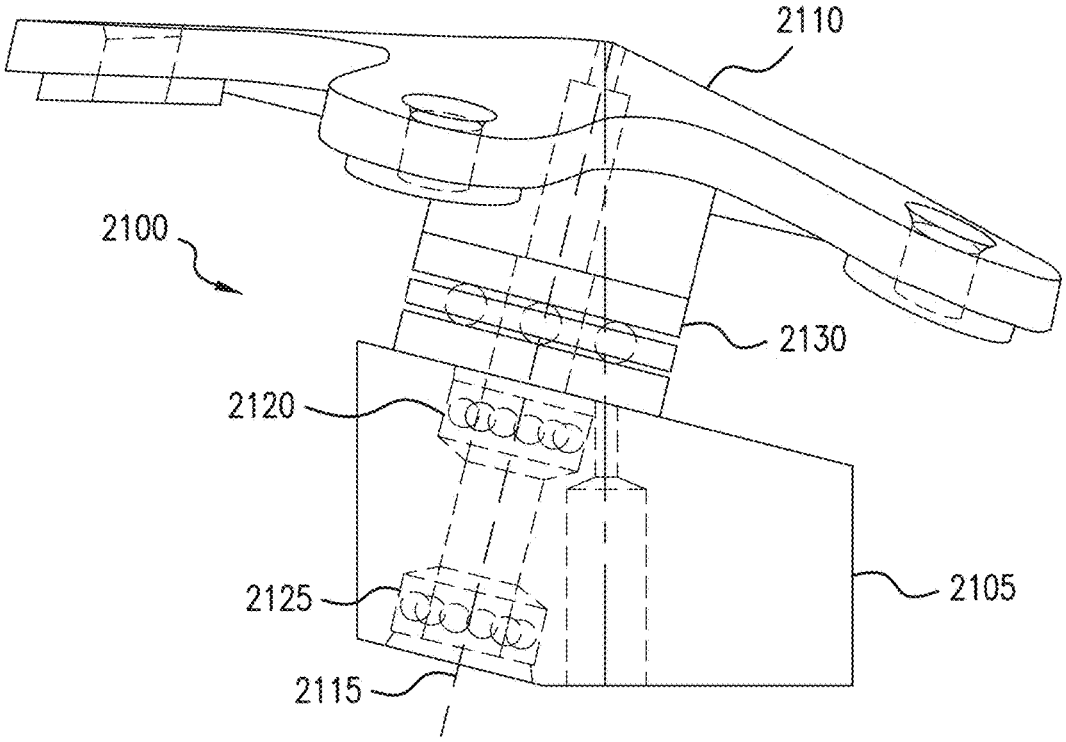
FIGS. 21-23B depict side projection and exploded views of exemplary pliable piston driver embodiments.

FIGS. 21-23B depict side projection and exploded views of some exemplary pliable piston driver embodiments. FIG. 21 depicts an exemplary design that follows above-described principles of operation, but incorporates ball bearings as load surfaces for the torsional force and radial reaction forces, and a thrust bearing for the linear force. A pump driver assembly 2100 includes a spinner 2105 operatively assembled to a wobble plate 2110 to rotate about an axis of rotation 2115. Bearing 2120 and 2125, respectively, provide reduced wear at contact points at the proximal and distal ends of the portion of the shaft that is inserted in the shaft receptacle of the spinner 2105. A thrust bearing 2130 supports a longitudinal force on the shaft in the direction of the axis 2115.

Figure 22A:
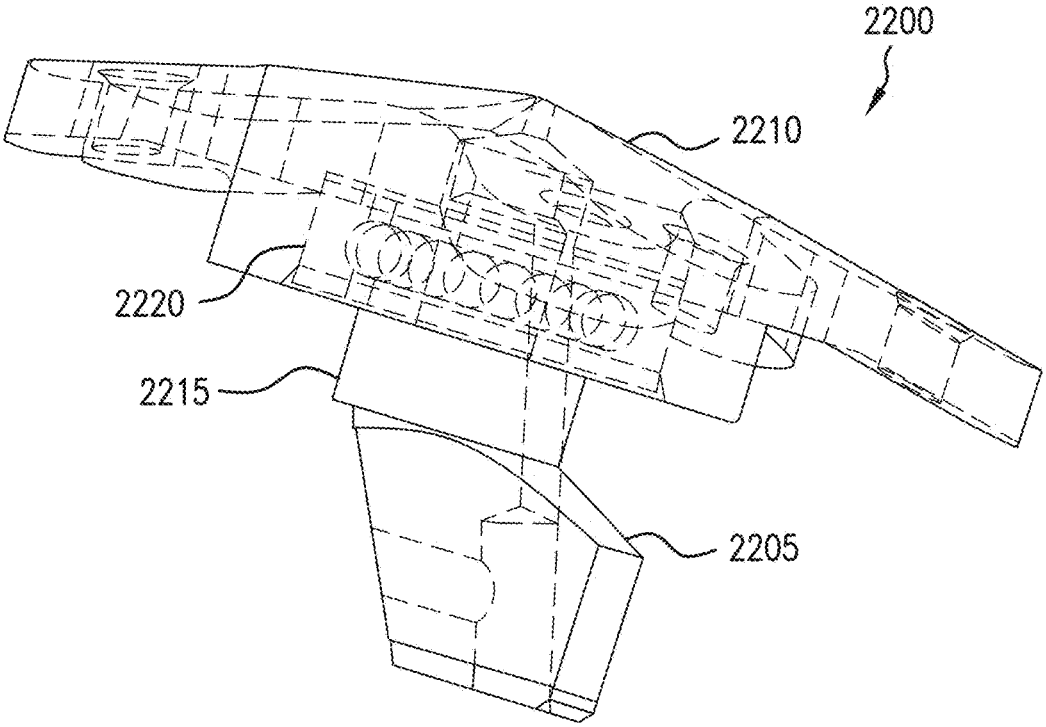
Figure 22B:
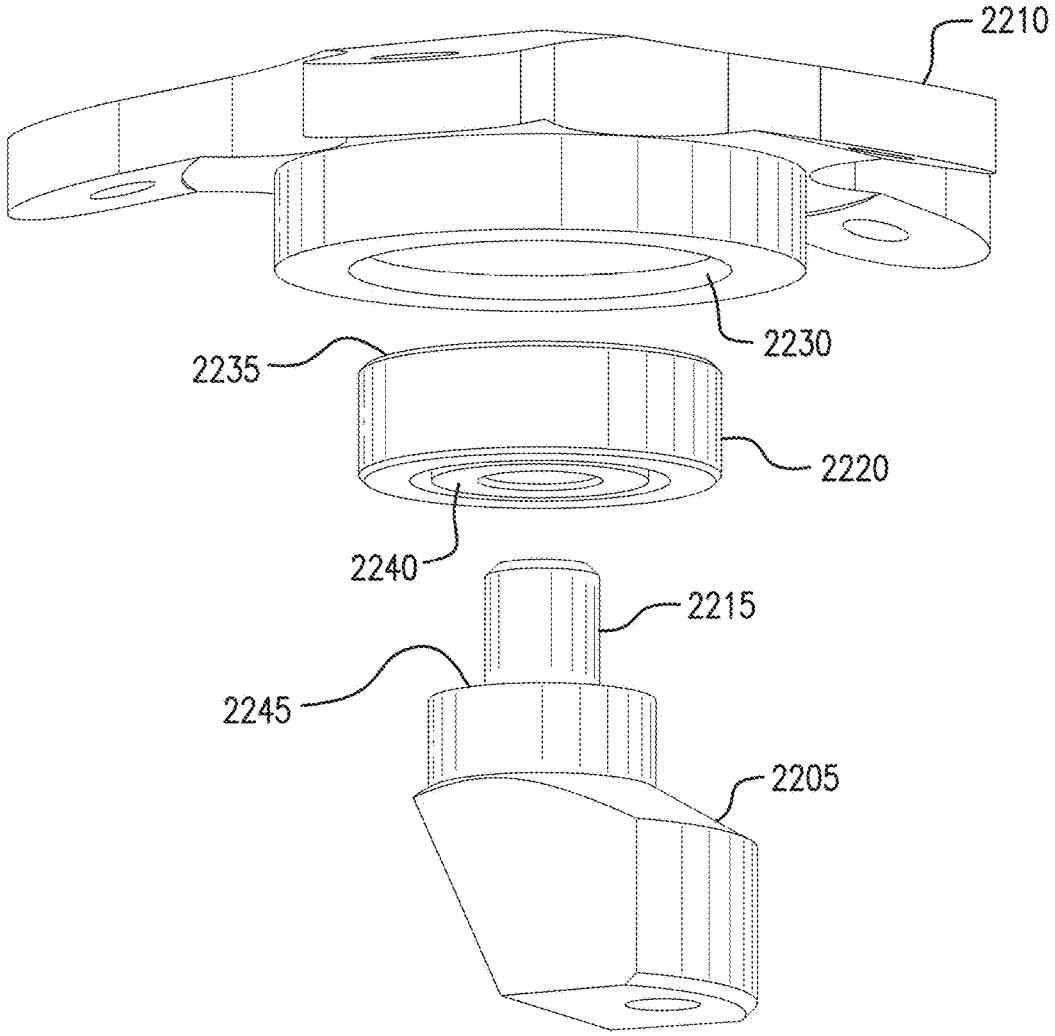
Figure 22C:
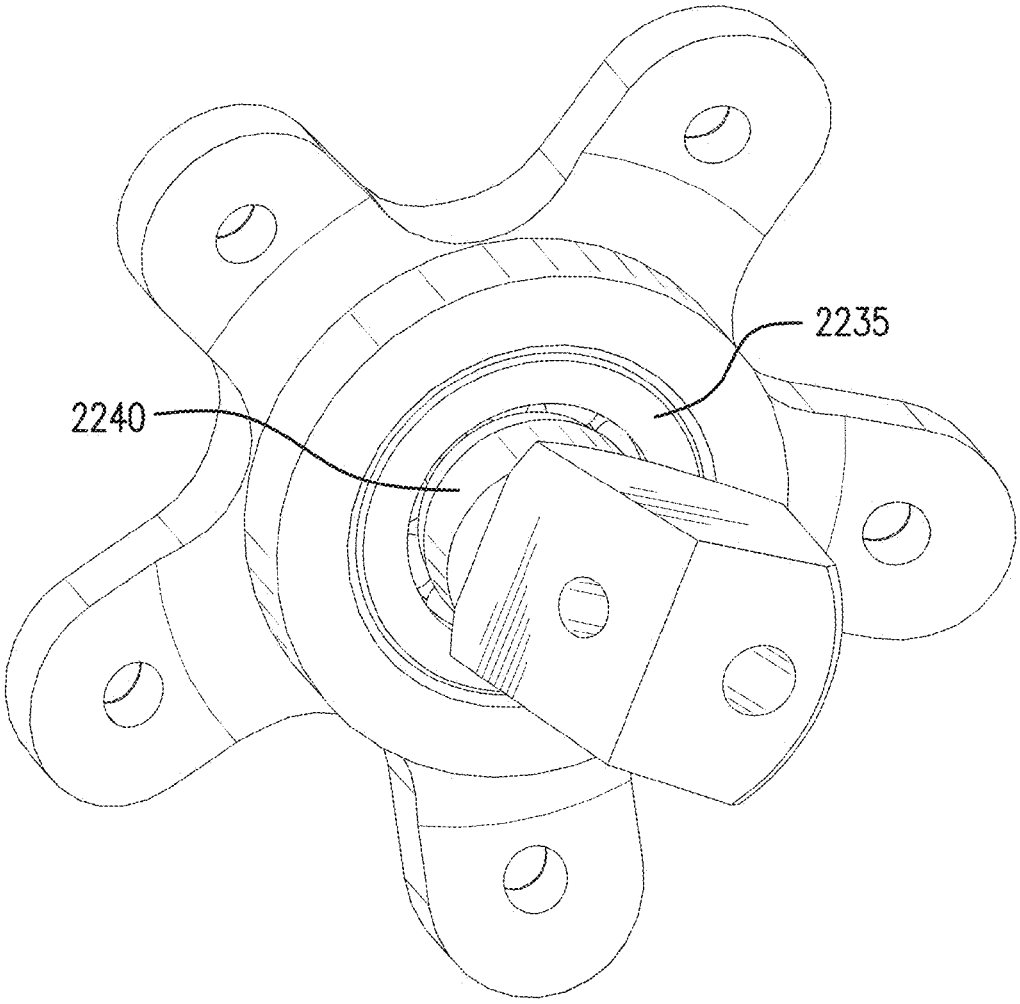

FIGS. 22A-22C depict an exemplary design that operates using an exemplary pump that includes an eccentric shaft fixed in the spinner and rotatably coupled to the wobble plate with a bearing at the top of the wobble plate's hole for the shaft. This embodiment incorporates ball bearings 2220 into a wobble plate 2210 to act as the load surface. In the depicted example, a spinner 2205 and a shaft 2215 may be formed as a uniform body in accordance with one exemplary implementation. As shown in further detail in FIG. 22B, the wobble plate 2210 includes an aperture 2230 sized to freely receive and be supported by the bearing 2220. The bearing 2220 includes an outer race having a top surface 2235 and an inner race with a bottom surface 2240. When the wobble plate 2210 is assembled onto the bearing 2220, the wobble plate 2210 may be supported primarily or substantially entirely by the top surface 2235 of the outer race. When the bearing 2220 is assembled onto the spinner shaft 2215, the bearing 2220 may be supported primarily or substantially entirely by a top surface 2245 of a shoulder formed by the shaft 2215 and the spinner 2205. The inner race and the outer race of the bearing 2220 are separated by an annular gap. In various embodiments, the relative rotation between the wobble plate 2210 and the spinner 2205 may advantageously be substantially free. In some embodiments, friction associated with such free rotation may be substantially minimized by the low friction performance characteristics of the bearing 2220.

In some implementations, assembly of the wobble plate 2210 to the bearing 2220 may be advantageously simplified by a substantially low friction coupling between the wobble plate 2210 and the bearing 2220. In various embodiments, the inner diameter of the aperture 2230 may be slightly larger than the outer diameter of the bearing 2220, such that the two do not have a tight interference fit. Accordingly, some wobble plates may be easily assembled or removed by hand, thereby yielding the ability to assemble, service or replace wobble plates or spinner/bearing components without the need for tools, adhesives, or other supplements. In some implementations, the interface between the wobble plate 2210 and the bearing 2220 may provide a freely releasable coupling along a longitudinal axis of the cylindrically shaped shaft 2215. In some implementations, the interface between the bearing 2220 and the shaft 2215 may provide a freely releasable coupling along a longitudinal axis of the cylindrically shaped shaft 2215.

Some embodiments may include a chamfer on the aperture 2230 to promote self-alignment of the aperture 2230 to the bearing 2220. Some embodiments may include a chamfer on a distal end of the shaft 2215 to promote alignment when assembling the bearing 2220 to the shaft 2215.

Figure 23A:
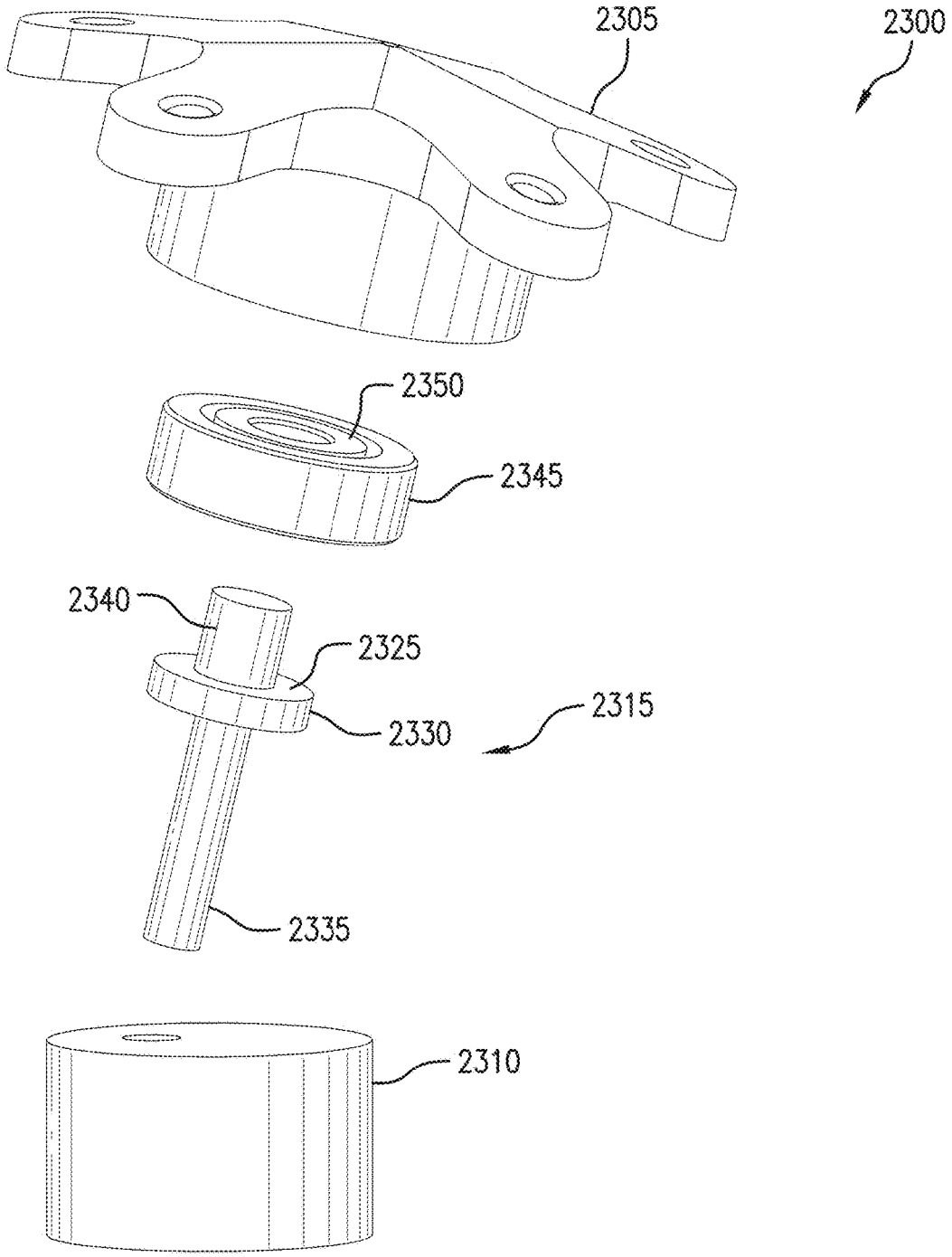
Figure 23B:
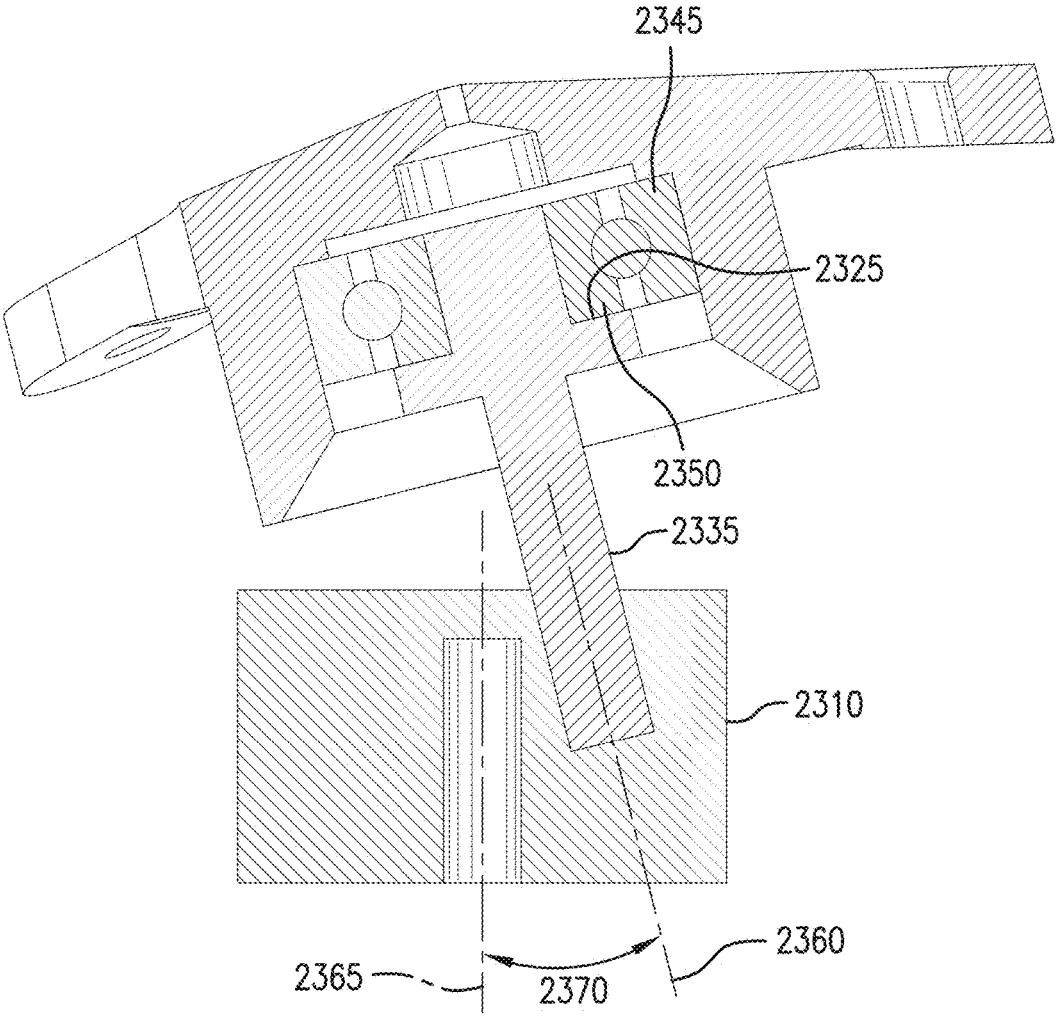

FIGS. 23A-23B depict an exemplary motor shaft rotation-to-nutating motion converter (MSR-NMC). In the depicted example, an MSR-NMC 2300 includes an umbrella linkage 2305 eccentrically coupled to a spinner 2310 by a shaft 2315. The spinner 2310 is configured to couple to a rotational drive shaft (not shown) to cause the umbrella linkages to effect a nutation motion to produce a substantially vertical reciprocation of the distal ends of the umbrella linkages.

The shaft 2315 includes a disc forming a shoulder having a top surface 2325 and a perimeter 2330. Extending down from the disc along a longitudinal axis of the shaft 2315 is a spinner shaft 2335. Extending up from the disc along the longitudinal axis of the shaft 2315 is a bearing shaft 2340. In the depicted figure, a radius of the disc perimeter 2330 is greater than a radius of either the spinner shaft 2335 or the bearing shaft 2340.

When assembled, the umbrella linkage 2305 is substantially supported by an outer race 2345 of a bearing, and the bearing shaft 2340 substantially supports an inner race of the bearing. In the depicted figure, material of the umbrella linkage is formed (e.g., removed) so as not to make contact with the inner race 2350. Shoulders are formed in a top annular ring, for example, inside the aperture of the umbrella linkage; these shoulders make contact with the outer race 2345. The inner race 2350 is separated from the outer race 2345 by an annular gap.

The diameter of the disc perimeter 2330 is less than an inner diameter of the outer race 2350, such that the disc does not make contact with the outer race 2345. In operation, the umbrella linkage 2305 is substantially free to rotate about a longitudinal axis 2360 of the shaft 2315 and relative to the inner race 2350-connected shaft 2315.

The spinner 2310 includes a receptacle to couple to a rotating drive shaft configured to rotate about an axis of drive rotation 2365. With respect to the drive rotation axis 2365, the longitudinal axis of the shaft 2315 is off-axis and canted at an angle 2370 determined by the receptacle in the spinner 2310.

In some embodiments, the spinner shaft 2335 may be keyed (e.g., D-shaped or with a flat) to a corresponding D-shaped receptacle in the spinner 2310. In some embodiments, the spinner shaft 2335 may be cylindrical and configured to freely spin in the receptacle in the spinner 2310.

In some implementations, assembly of the umbrella linkage 2305 to the bearing outer race 2345 may be advantageously simplified by a substantially low friction coupling between the umbrella linkage 2305 and the bearing outer race 2345. In various embodiments, the inner diameter of an aperture that receives the outer race 2345 may be slightly larger than the outer diameter of the bearing outer race 2345, such that the two do not have a tight interference fit. Accordingly, some umbrella linkage 2305 may be easily assembled or removed by hand, thereby yielding the ability to assemble, service or replace umbrella linkage 2305 or the bearing components without the need for tools, adhesives, or other supplements. In some implementations, the interface between the umbrella linkage 2305 and the bearing may provide a freely releasable coupling along a longitudinal axis of the cylindrically shaped shaft 2340. In some implementations, the interface between the bearing inner race 2350 and the bearing shaft 2325 may provide a freely releasable coupling along a longitudinal axis of the cylindrically shaped shaft 2340.

Some embodiments may include a chamfer on the aperture in the umbrella linkage 2305 to promote self-alignment of the aperture to the bearing outer race 2345. Some embodiments may include a chamfer on a distal end of the bearing shaft 2325 to promote alignment when assembling the bearing to the bearing shaft 2325.

FIG. 24 is a chart depicting exemplary combinations of design elements for a pneumatic pump. In various implementations in accordance with the various principles described herein, embodiments of a durable canted off-axis pneumatic pump may be configured from selected design elements. The design elements represented in the depicted table include, for each Pump ID 2405, a diaphragm type 2410, spinner type 2415, a lubricant type 2420, shaft type 2425 (e.g., material hardness). Other parameters may be permutated, by way of example and not limitation, number of radial arms, diameters of the eccentric hole in the spinner, bearings, or shaft, and/or number of ball bearings 2440. For convenient reference, the permutations for each pump ID 2405 may be described in a shorthand code 2445.

For purposes of illustration and not limitation, various exemplary embodiments may include a diaphragm formed of rubbers (e.g., EPDM (ethylene propylene diene monomer) rubber, HNBR (hydrogenated nitrile butadiene rubber)). A spinner may include thermoplastics (e.g., POM (polyoxymethylene), PPS (polyphenylene sulfide)), PEI (polyethylenimine), Bronze 510, Oilite, POM with a wear additive, or a combination thereof. For lubrication, some embodiments may incorporate EM50L, petroleum lubricant, or no lubricant. In various embodiments, by way of example and not limitation, some implementations may include any of a hardened shaft, two or more ball bearings, and/or an extended length spinner.

In one illustrative example, an exemplary pump may include EPDM diaphragm, a POM spinner, and EM50L lubricant.

In another illustrative example, an exemplary pump may include an eccentric shaft fixed in the spinner and rotatably coupled to the wobble plate with a bearing at the top of the wobble plate's hole for the shaft. In an illustrative example, an exemplary pump may include EPDM or HNBR diaphragm, a POM spinner, a POM or POM with wear additive wobble plate, and EM50L lubricant.

In another illustrative example, an exemplary pump may include EPDM diaphragm, a POM with wear additive spinner, and EM50L lubricant.

In another illustrative example, an exemplary pump may include an EPDM or HNBR diaphragm, a Bronze spinner, and EM50L or petroleum lubricant.

In another illustrative example, an exemplary pump may include an extended height spinner, EPDM diaphragm, a POM, oil-impregnated POM, of PTFE (polytetrafluoroethylene)-impregnated POM spinner, and EM50L lubricant.

Some implementations may provide automatic self-lubrication and/or ejection of wear material.

In another illustrative example, an exemplary pump may include non-metal spinners with EM50L or petroleum lubricant and both diaphragm materials. Some embodiments may include a second ball bearing in the spinner hole or a hardened shaft. Various embodiments may include, for example, EPDM or HNBR diaphragm, a POM, PPS, or PE (polyethylene) spinner, and EM50L or petroleum lubricant, with a hardened shaft and two bearings.

In another illustrative example, an exemplary pump may include an oil-impregnated metal, such as Oilite. Some embodiments may include, for example, EPDM or HNBR diaphragm, Oilite spinner, and EM50L lubricant.

In another illustrative example, an exemplary pump may include an EPDM diaphragm, a POM spinner, and EM50L lubricant, with increased load surface achieved by increased eccentric hole, shaft and bearing diameter.

Although various embodiments have been described with reference to the Figures, other embodiments are possible. For example, in some embodiments noise may be reduced in systems that are designed for a maximum throughput greater than a predetermined specification corresponding to a specific application. The pneumatic pump may then be operated at a sub-maximal flow rate.

In some embodiments, the angle difference between the motor drive axle and the piston drive axle may affect operating parameters of the pump. For example, if the angle difference is small, the flow rate may be reduced and/or the lifetime may be increased. In some embodiments, if the angle difference is large, the flow rate may be increased, but at the possible expense of noise being increased and greater wear resulting in attenuated life. In some embodiments the angle difference may be between ten and fourteen degrees, for example.

The angle of the radial arm members relative to the shaft 1220 may also be varied. In some embodiments, an exemplary angle may generally approximate the angle between the motor drive axle and the piston drive axle. This angle generally allows for the arm 260 to reach a state perpendicular to the axis of the pump 255 that positions the piston so that the face of the piston 226 is in a parallel plane to the face of the cylinder head 227 at top dead center giving greater efficiency by evacuating a maximum amount of air from the cylinder in a compression stroke.

Various embodiments may use various materials for each of the pump components. For example, the piston drive member may be made of metal. For example, the piston drive member may be made of steel. In an exemplary embodiment, the piston drive member may be made of aluminum. In some embodiments, the piston drive member may be made of plastic. For example, the piston drive member may include Polyphenylene Sulfide (PPS) plastic. In an exemplary embodiment, the piston drive member may include Polyether Imide (PEI) plastic. In some embodiments, the piston drive member may include Polyoxymethylene (PEM) plastic. Some embodiments may include nylon plastic in one or more pump members, including the piston drive member.

In some embodiments, the intake manifold may be split into separate intake lines, each corresponding to a piston. This split intake manifold may minimize noise associated with intake of fluid.

Various embodiments may exhibit improved durability and service life when a canted off-axis drive is configured to reciprocate a number of pliable pistons operably connected to an equal number of radially arranged piston cranks, with an optimized Moment-Insertion Ratio (MIR) between (i) a radial moment arm of any one of the piston cranks and (ii) a shaft insertion depth into a canted off-axis driver bearing. In an illustrative example, the optimal MIR may yield substantially reduced wear and improved service life when the forces that the canted off-axis driver bearing imparts radially onto the shaft are substantially equal and opposite in magnitude. The radial moment arm may extend from an axis of the shaft to, for example, any of at least two linearly actuatable pliable-pistons. In some embodiments, each of the radially arranged piston cranks may be coupled to the shaft at a common point along the shaft.

In some embodiments, the drive shaft receptacle may be configured to prevent relative rotation between the spinner body and the drive shaft. The drive shaft receptacle may be keyed to correspond to and receive a non-cylindrical drive shaft with a corresponding key feature such that the spinner body rotates synchronously with the drive shaft. The drive shaft receptacle may have at least one flat side corresponding to each of at least one flat side of the drive shaft, for example. The drive shaft receptacle may rigidly couple to the drive shaft, such as by integral molding (e.g., dip molding or the like) to form the spinner to a drive shaft. In some examples, the drive shaft may provide a non-cylindrical surface, such as positive and negative surface features, to increase the torque capability of the molded spinner to the drive shaft. Some embodiments may employ a pin or set screw, for example, to secure the spinner body against rotation with respect to the drive shaft.

In various embodiments, a spinner, such as the spinners 2205 or 2310, for example, may nutate the wobble plate in response to the rotation of a drive shaft about a drive axis of rotation. In various examples, the longitudinal axis may be offset and canted with respect to a drive axis of rotation A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are contemplated to be within the scope of the following claims.

What is claimed is:

1. An apparatus comprising:

an umbrella shaft rigidly extending along a longitudinal axis;

an umbrella linkage rigidly coupled to a distal end of the umbrella shaft, the umbrella linkage having a plurality of distal members extending radially from the longitudinal axis;

a spinner body formed as a substantially rigid body having a proximal face and a distal face;

a drive shaft receptacle formed in the proximal face and extending along a drive axis of rotation of a drive shaft, wherein the spinner body rotates about the drive axis of rotation of, and synchronously with, the drive shaft; and, an eccentric shaft receptacle formed as a substantially cylindrical chamber in the distal face for receiving a proximal portion of the umbrella shaft, wherein the longitudinal axis is offset from and at an acute angle with respect to the drive axis of rotation, and wherein when the proximal portion of the umbrella shaft is inserted into the shaft receptacle, the umbrella shaft has at each point along the proximal portion of the umbrella shaft an outer diameter that is less than a corresponding inner diameter of the shaft receptacle adjacent to that point such that the umbrella shaft is freely rotatable with respect to the spinner body and without binding, wherein the distal end of each one of the plurality of distal members of the umbrella linkage includes an attachment aperture for attaching to a stationary deflectable piston crank, wherein a moment arm L1 is defined by a minimum distance from the longitudinal axis of the shaft to a centerline parallel to the longitudinal axis and passing through a center of one of the attachment apertures, a moment arm L3 is defined by a distance along the longitudinal axis of the proximal portion of the umbrella shaft that is inserted into the eccentric shaft receptacle, and a ratio of L1 to L3 is between about 1.5 and about 1.75.

2. The apparatus of claim 1, wherein the distal end of each one of the plurality of distal members drives the piston crank with a substantially linear reciprocating motion profile in response to rotation of the drive shaft.

3. The apparatus of claim 2, wherein the substantially linear motion profile runs substantially parallel to the drive axis of rotation.

4. The apparatus of claim 1, further comprising a ball bearing disposed between a distal end of the shaft and a bottom wall of the eccentric shaft receptacle.

5. The apparatus of claim 1, further comprising the drive shaft receptacle configured to prevent relative rotation between the spinner body and the drive shaft.

6. A method comprising:

providing an umbrella shaft rigidly extending along a longitudinal axis;

rigidly coupling an umbrella linkage to a distal end of the umbrella shaft, the umbrella linkage having a plurality of distal members extending radially from the longitudinal axis;

providing a spinner body formed as a substantially rigid body having a proximal face and a distal face;

providing a drive shaft receptacle formed in the proximal face and extending along a drive axis of rotation of a drive shaft;

rotating the spinner body about the drive axis of rotation of, and synchronously with, the drive shaft;

receiving a proximal portion of the umbrella shaft in an eccentric shaft receptacle formed as a cylindrical chamber in the distal face;

inserting the proximal portion of the umbrella shaft into the eccentric shaft receptacle, wherein the outer diameter of the umbrella shaft has at each point along the proximal portion of the umbrella shaft an outer diameter that is less than a corresponding inner diameter of the eccentric shaft receptacle adjacent to that point such that the umbrella shaft is freely rotatable without binding with respect to the spinner body; and, attaching a stationary deflectable piston crank to an attachment aperture at the distal end of each one of the plurality of distal members of the umbrella linkage, wherein a moment arm L1 is defined by a minimum distance from the longitudinal axis of the shaft to a centerline parallel to the longitudinal axis and passing through a center of one of the attachment apertures, a moment arm L3 is defined by a distance along the longitudinal axis of the proximal portion of the umbrella shaft that is inserted into the eccentric shaft receptacle, and a ratio of L1 to L3 is between about 1.5 and about 1.75.

7. The method of claim 6, further comprising driving, with the distal end of one of the plurality of distal members, the piston crank with a substantially linear reciprocating motion profile in response to rotation of the drive shaft.

8. The method of claim 7, wherein the substantially linear motion profile runs substantially parallel to the drive axis of rotation.

9. The method of claim 6, further comprising disposing at least one ball bearing between a distal end of the shaft and a bottom wall of the eccentric shaft receptacle.

* * * * *